US006269982B1

(12) United States Patent
Kreiseder et al.

(10) Patent No.: US 6,269,982 B1
(45) Date of Patent: Aug. 7, 2001

(54) TRIGGER ACTIVATED PRODUCT DISPENSER

(75) Inventors: Walter J. Kreiseder; Thomas C. Stoneberg, both of Buffalo Grove; William C. Schmeisser, Barrington, all of IL (US)

(73) Assignee: Courtesy Corporation, Buffalo Grove, IL (US)

( * ) Notice: Subject to any disclaimer, the term of this patent is extended or adjusted under 35 U.S.C. 154(b) by 0 days.

(21) Appl. No.: 09/611,272

(22) Filed: Jul. 6, 2000

(51) Int. Cl.[7] ..... G01F 11/00
(52) U.S. Cl. ..... 222/390; 222/326; 401/175
(58) Field of Search ..... 222/390, 391, 222/325, 326, 327; 401/62, 68, 172, 174, 175, 181, 179

(56) References Cited

U.S. PATENT DOCUMENTS

| | | | | |
|---|---|---|---|---|
| 4,318,499 | | 3/1982 | Hamilton | 222/391 |
| 4,865,231 | | 9/1989 | Wiercinski | 222/390 |
| 5,372,444 | | 12/1994 | Lhuisset | 401/175 |
| 5,570,821 | | 11/1996 | Dejonge | 222/391 |
| 5,573,341 | | 11/1996 | Iaia | 401/172 |
| 5,725,133 | * | 3/1998 | Iaia | 222/390 |
| 5,839,622 | * | 11/1998 | Bicknell et al. | 222/390 |
| 5,860,572 | | 1/1999 | Harrold et al. | 222/391 |

* cited by examiner

*Primary Examiner*—Kevin Shaver
*Assistant Examiner*—Patrick Buechner
(74) *Attorney, Agent, or Firm*—Silverman, Cass & Singer, Ltd.

(57) ABSTRACT

A dispenser for dispensing a product from a body having a pivot flange formed on the external surface thereof. A trigger is mounted on the pivot flange to be pivotal thereupon by a user's hand wrapped about the body with the user's finger digits positioned on the trigger. A product engaging platform is mounted upon a screw gear positioned within the body and is movable to dispense the product from the body when the screw gear is turned by pivotal movement of the trigger and engagement thereof against the screw gear. The product to be dispensed may be retained in a cartridge which is removable and replaceable within the body.

26 Claims, 38 Drawing Sheets

172
170
158
10
168
162
164
14
166
12
16
38
144
22
40
18
36
50
26
20
150
24
148
120
152
102
26
104
108
106
68
142
70
82
72
62
66
64
94
128
96
46
126
146
48
52
60
42
100
41
44
58
98
76
78
74
86

166
14
180
180
12
16
18
36
20
50

10
12
16
32
18
34
112
13
76
102
118
130
132
104
120
134
122
54
124
114
146
66
22
138
136
68
80
140
150
106
108
72
78
110
84
88
100
142
74
86
20
64
96
42
41
92
94
62
70
98
52
100
82

200

214
218
216
212
240
226
227
224
227
226
222
238
236
251
269
271
220
257
354
352
356
360
370
358
254
386
242
298
248
246
252
253
249
225
245
243
241
247
382
276
267
278
274
286

214
212
218
216
236
251
220
271
269
257

576
517
586
574
573

512'
514
500
516
518
536
576
517
553
549
586
574
550
520

TRIGGER ACTIVATED PRODUCT DISPENSER

BACKGROUND OF THE INVENTION

1. Field of the Invention

This invention relates generally to product dispensers, and more particularly, to such dispensers having a trigger activated product advancing riser or platform positioned within the dispenser to move the product contained therein toward a dispensing opening thereof.

2. Description of the Prior Art

Trigger or lever activated product dispensers are known, as represented by the prior art patents of record herein. Such dispensers commonly are used to dispense deodorant or other products retained within the dispenser body in either solid, liquid, gel, cream or paste form. The dispenser body includes an open end at which the product retained therein is to be dispensed, and a closed end opposite said open end proximate which the product is retained and to be advanced through the dispenser body toward the open end for dispensing thereof. A platform or riser commonly is positioned within the dispenser body between the product and the closed end and is movable toward the open end upon activation thereof by screws, levers, springs or other means, so as to move the product out of the open end and thereby dispense same from the dispenser.

Prior art product dispensers of the type described generally are of complex construction requiring multiple parts that are relatively difficult to manufacture and/or assemble so as to provide a desired construction that is reliable during usage for dispensing of the product retained therein. Accordingly, it is desirable to provide a generally uncomplex and easily manufacturable dispenser for dispensing product by trigger activation of dispensing means formed within the dispenser, the operation of which is reliable during usage to accomplish the desired dispensing of the product retained therein.

It also is desirable to provide such a product dispenser which is usable for a wide range of products, such as solids, liquids, gels, creams or pastes, and which includes constructional features to permit retracting of the product back into the dispenser as well as dispensing therefrom, when desired. It also is desirable to provide such a product dispenser which is adaptable for use with cartridge-loaded product retaining members, thereby rendering such a dispenser re-fillable with a fresh product-retaining cartridge when desired.

SUMMARY OF THE INVENTION

The invention provides a product dispenser including a body with a pivot flange positioned on the external surface thereof. A trigger piece is mounted on the body and is pivotal thereon about the pivot flange when a user's hand is wrapped around the body with the user's hand/finger digits positioned upon the trigger piece. A screw gear with connected axle is positioned within the body and is engaged by a gear advancing member in the form of a finger or ribs to be activated by the lower portion of the trigger. A product engaging platform or riser is mounted upon the gear axle and moves up/down when the screw gear is turned clockwise/counterclockwise. To advance the product within the body toward an open end thereof, and thereby dispense the product, the user actuates the trigger by pulling thereagainst at a first end thereof with a digit of the user's hand to cause the gear advancing member to move or rotate the gear one notch in a first direction and thereby advance the riser upwardly. To withdraw the product back into the body, the user actuates the trigger by pulling thereagainst at a second end thereof with another digit of the user's hand to cause the gear advancing member to move or rotate the gear one notch in the opposite direction and thereby withdraw the riser downwardly.

The invention also provides a product dispenser in which the body is adapted for receipt therein of a removable and replaceable product-retaining cartridge which includes a screw gear and connected axle for engagement by the gear advancing member to be activated by the trigger and dispense product from or retract product back into the cartridge in substantially the same manner as the first described product dispenser.

DESCRIPTION OF THE PREFERRED EMBODIMENTS

Figure 1:
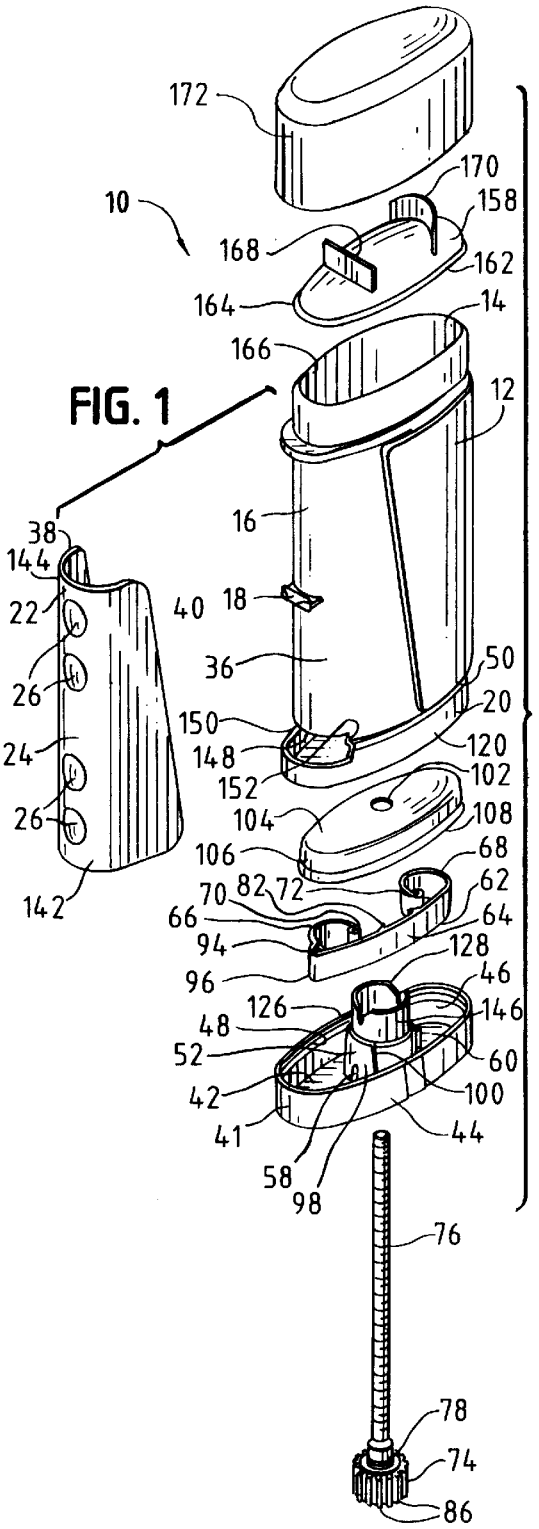
FIG. 1 is an exploded perspective view of a first embodiment of the trigger activated product dispenser of the invention, the same being a toggle trigger activated dispenser.

Referring to the drawings, FIG. 1 illustrates a product dispenser 10 of the type commonly used to dispense deodorant product or the like in solid form. The dispenser 10 includes a body 12 having an open end 14 through which the deodorant product can be dispensed as it is moved within the body toward the open end 14 in the manner described hereinafter. The cross-sectional configuration of the body 12 is illustrated as being generally elliptical, but it is contemplated that other configurations, such as round or rectangular, may be used within the scope of the invention.

Figure 2:
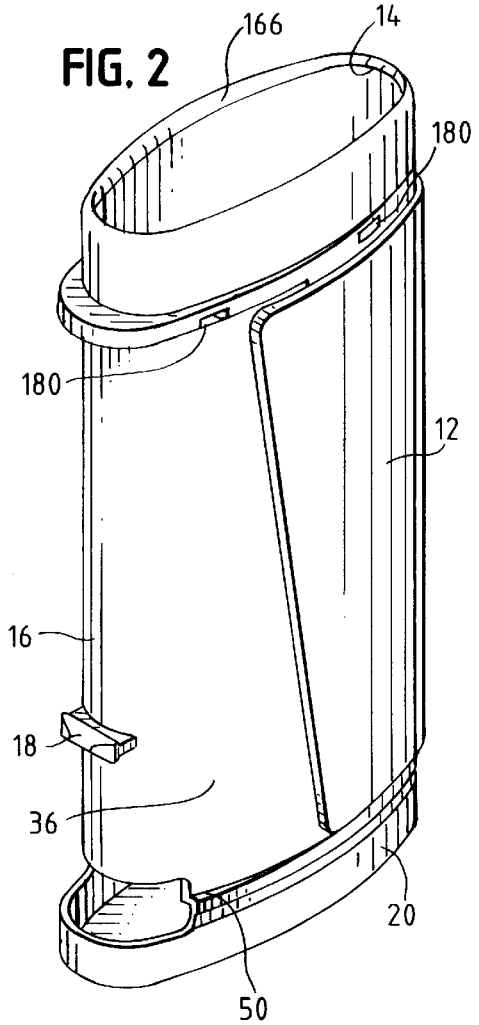
FIG. 2 is a perspective view of the body thereof.
Figure 4:
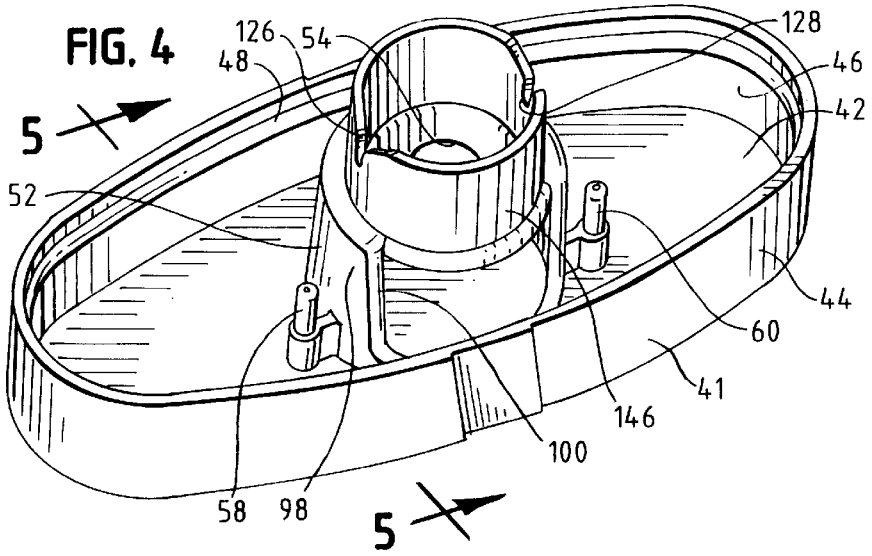
FIG. 4 is a perspective view of the toggle trigger base thereof.
Figure 3:
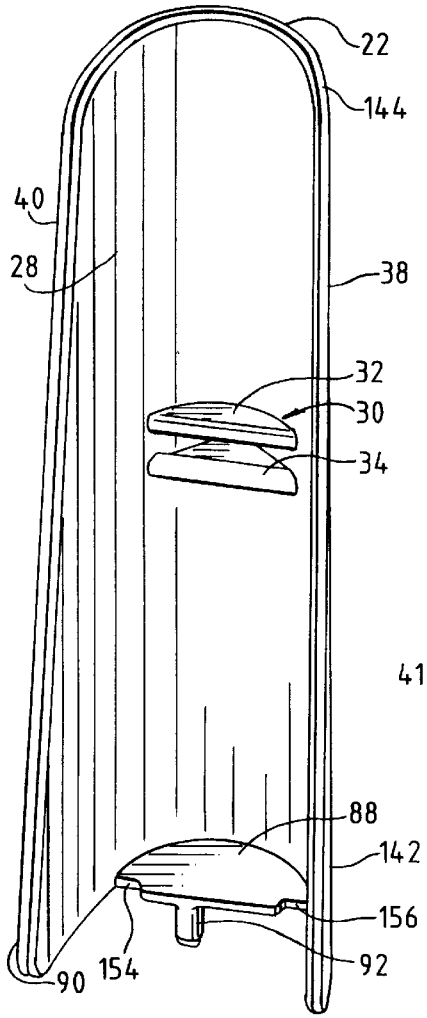
FIG. 3 is a rear perspective view of the toggle trigger thereof.
Figure 5:
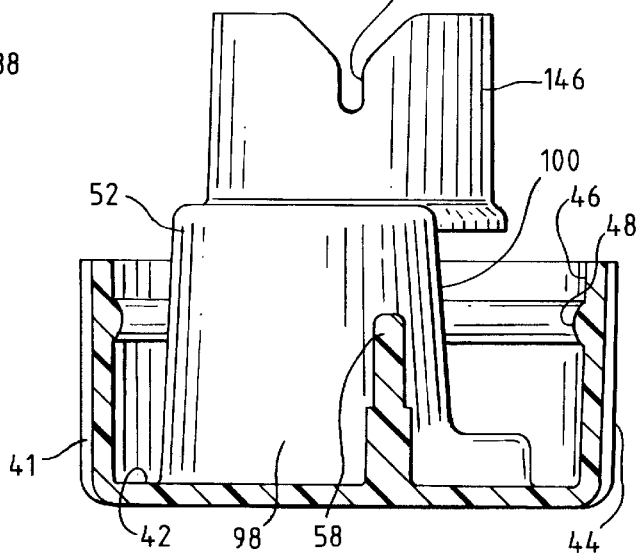
FIG. 5 is a sectional view taken along the line 5—5 of FIG. 4, in the direction indicated generally.
Figure 6:
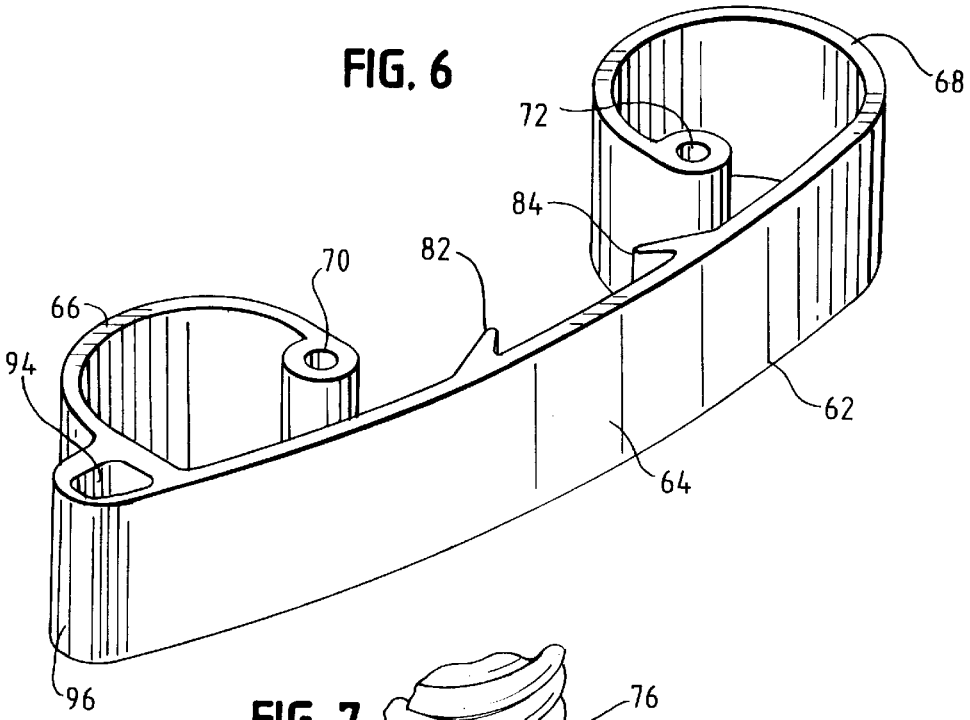
FIG. 6 is a perspective view of the spring with engagement ribs of said toggle trigger activated dispenser.
Figure 7:
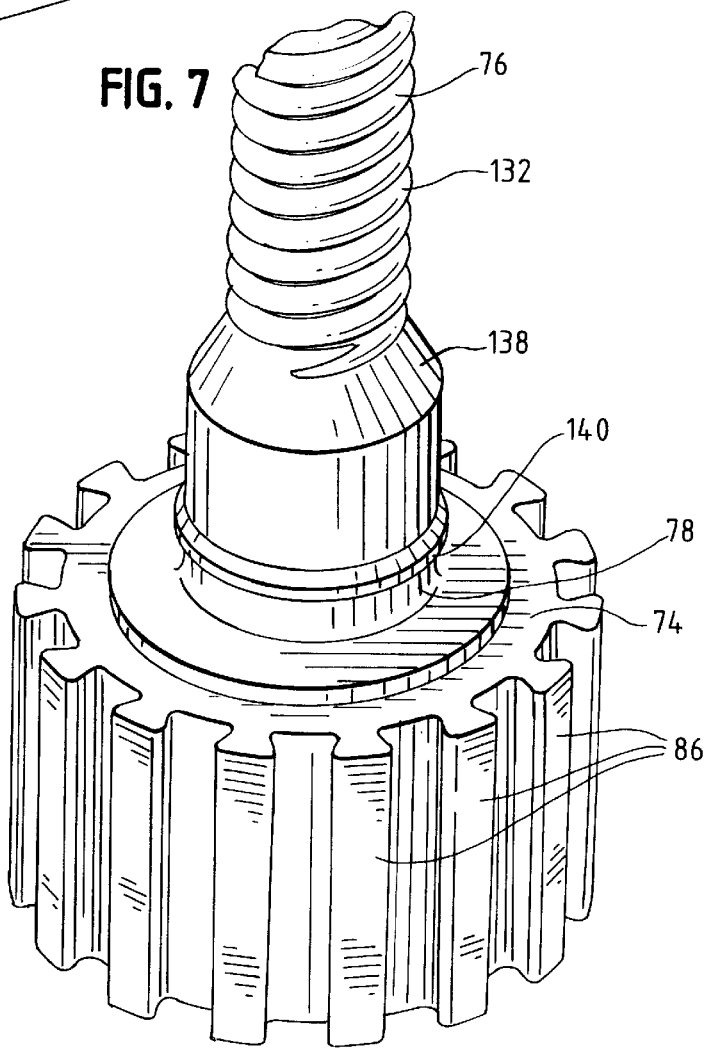
FIG. 7 is a partially fragmentary perspective view of the screw gear and axle thereof.
Figure 8:
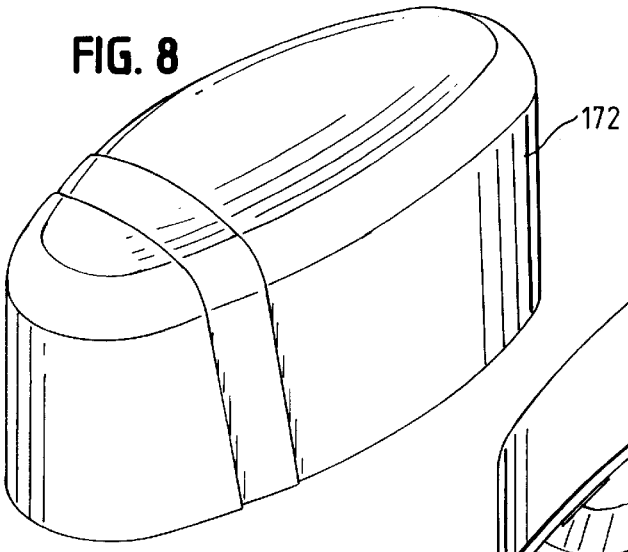
FIG. 8 is a top perspective view of the cover thereof.
Figure 9:
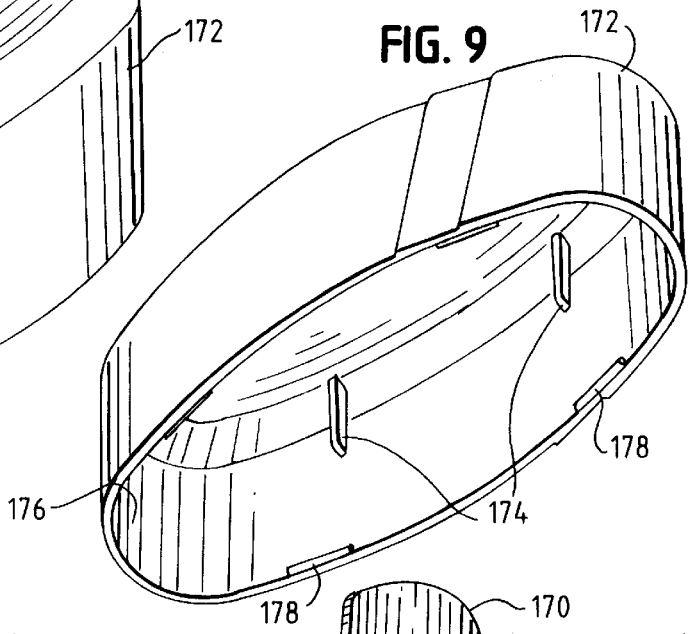
FIG. 9 is an underside perspective view of the cover shown in FIG. 8.
Figure 10:
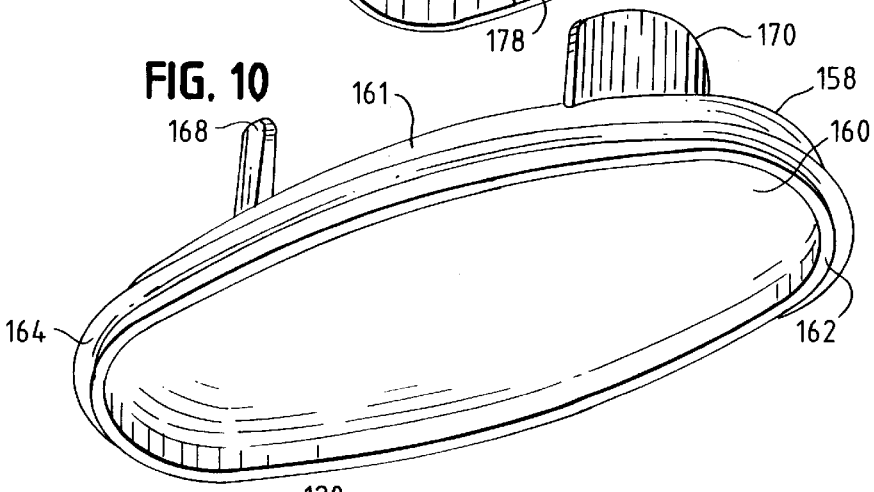
FIG. 10 is a perspective view of the contour cap thereof.
Figure 11:
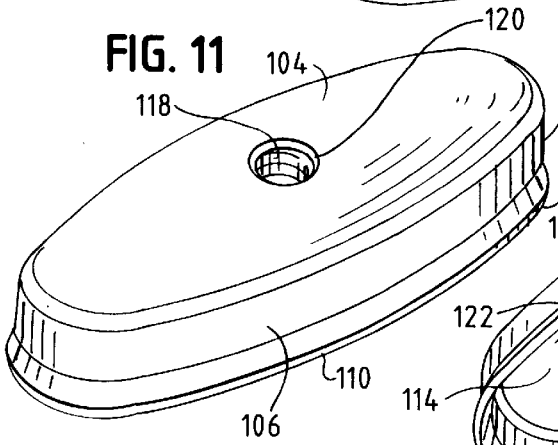
FIG. 11 is a top perspective view of the riser or product engaging platform thereof.
Figure 12:
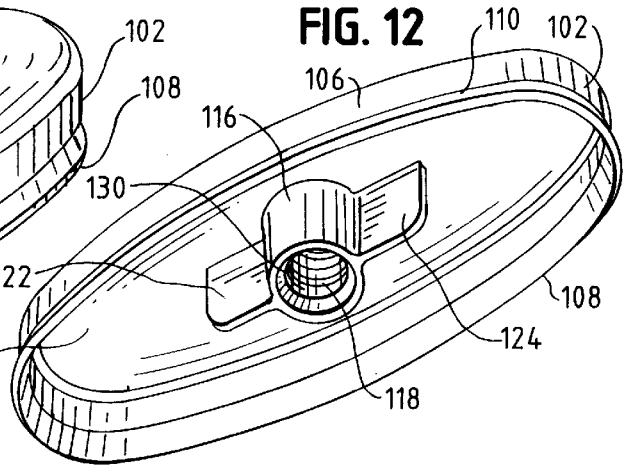
FIG. 12 is an underside perspective view of the riser shown in FIG. 11.
Figure 14:
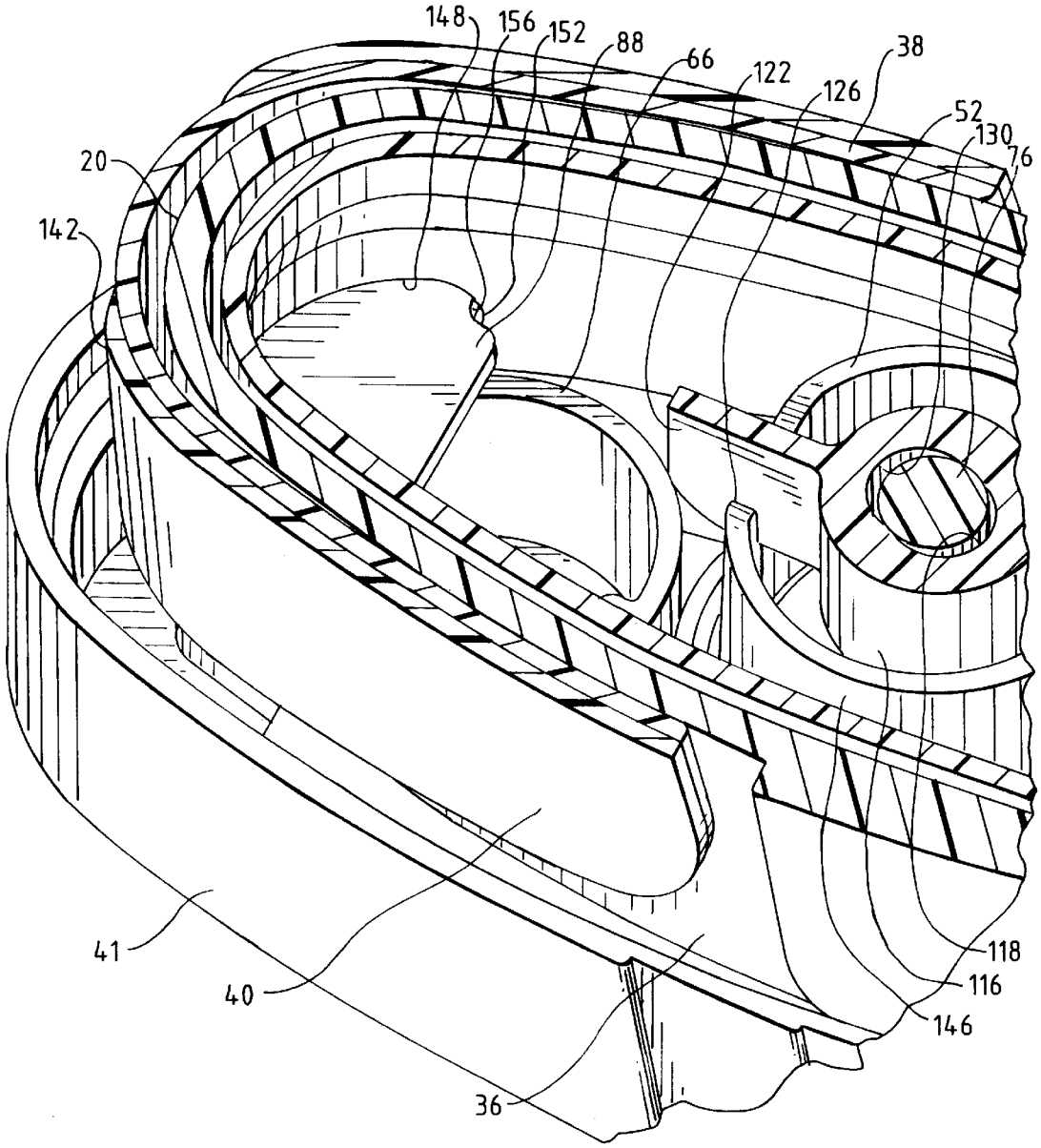
FIG. 14 is an enlarged, sectional, fragmentary view of the inside lower portion of the product dispenser shown in FIG. 1.
Figure 15:
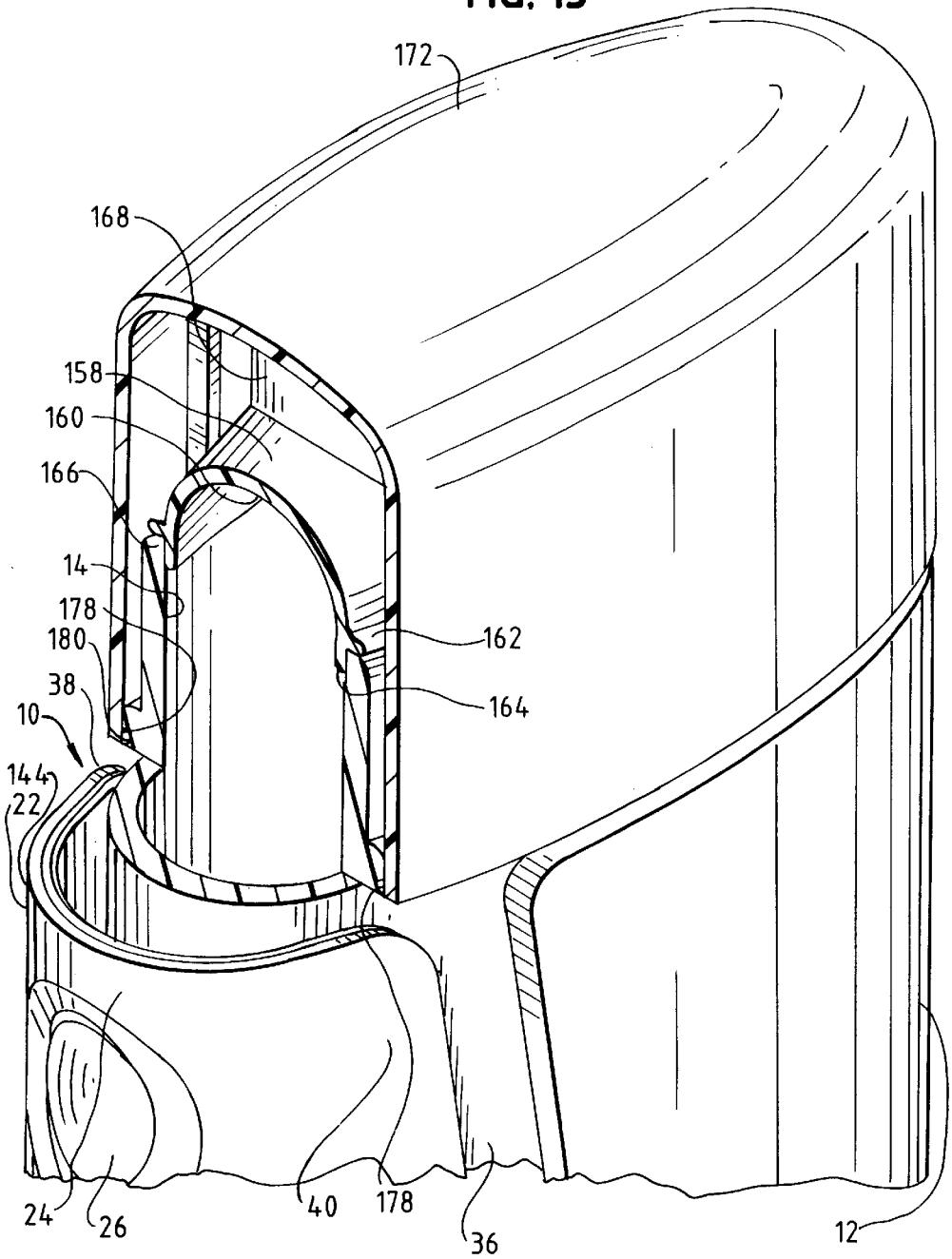
FIG. 15 is a sectional, fragmentary view of the upper portion of the product dispenser shown in FIG. 1.

Body 12 is provided on the external surface 16 thereof with a pivot flange 18 which extends from said surface 16 at a location spaced approximately mid-length the distance between open end 14 and the opposite end 20 thereof. The invention contemplates that the precise location of pivot flange 18 can be varied along the mid-length of body 12 between a point near the precise mid-length (as seen in FIG. 1) to any other point which may be closer to either open end 14 or opposite end 20 (as seen in FIG. 2). A toggle trigger 22 having an external surface 24 with multiple depressions 26 to comfortably fit the digits or palm of a user's hand is adapted for positioning against the external surface 16 of body 12. (The external surface 24 of toggle trigger 22 shown in the drawings is for purposes of illustration only; any other surface configuration, such as flat, round or contoured ergonomic shape is contemplated to be within the scope of the invention). External surface 16 of body 12 is formed with a recessed area 36 to accommodate generally U-shaped trigger wings 38, 40 of toggle trigger 22 which act as guides for the toggle trigger and provide a smooth external configuration of the trigger/body parts when they are assembled together (see FIG. 14). The interior surface 28 of toggle trigger 22 (see FIG. 3) which is positioned against surface 16 of body 12 is formed with a pivot flange engaging clip 30 having a pair of parallel spaced snap members 32, 34 which snap-fit upon pivot flange 18 to secure toggle trigger 22 to body 12.

A base 41 is provided for attachment to body 12 to close end 20 thereof which is disposed opposite open end 14. Base 41 is of generally cup-shaped configuration with a bottom wall 42 and a circumferentially disposed upstanding end wall 44. End wall 44 is formed on the inner-facing surface 46 thereof with a projecting rib 48 to be matingly engaged within circumferential groove 50 formed on body 12 for snap-fit attachment of the base 41 upon the body 12.

An upstanding, centrally-located tower 52 is formed on bottom wall 42 of base 41 and includes a mounting hole 54 for receipt of the gear 74 and connected screw axle 76 in a manner to be described hereafter. A pair of upstanding mounting posts 58, 60 are formed on the bottom wall 42 positioned on opposite sides of tower 52.

A spring 62 constructed from resilient material is provided for positioning upon base 41 resting on bottom wall 42. Spring 62 includes an elongate main wall portion 64 with oppositely disposed generally circular terminal portions 66, 68, each of which is formed with a respective mounting hole 70, 72 to facilitate mounting of the spring within base 41 by engagement of mounting posts 58, 60 within respective mounting holes 70, 72.

Figure 16:
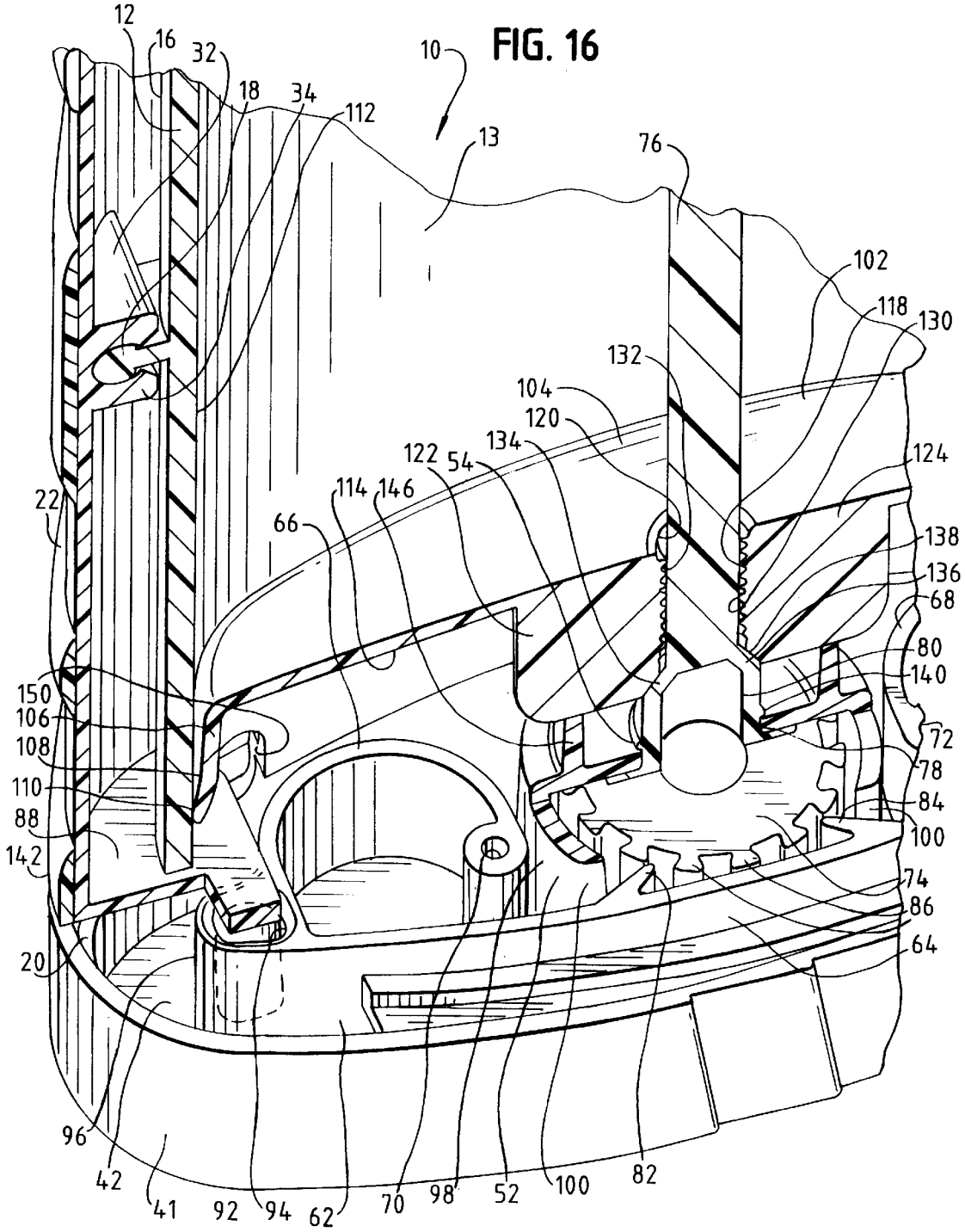
FIG. 16 is a sectional, fragmentary view of the lower portion of the product dispenser shown in FIG. 1.
Figure 17:
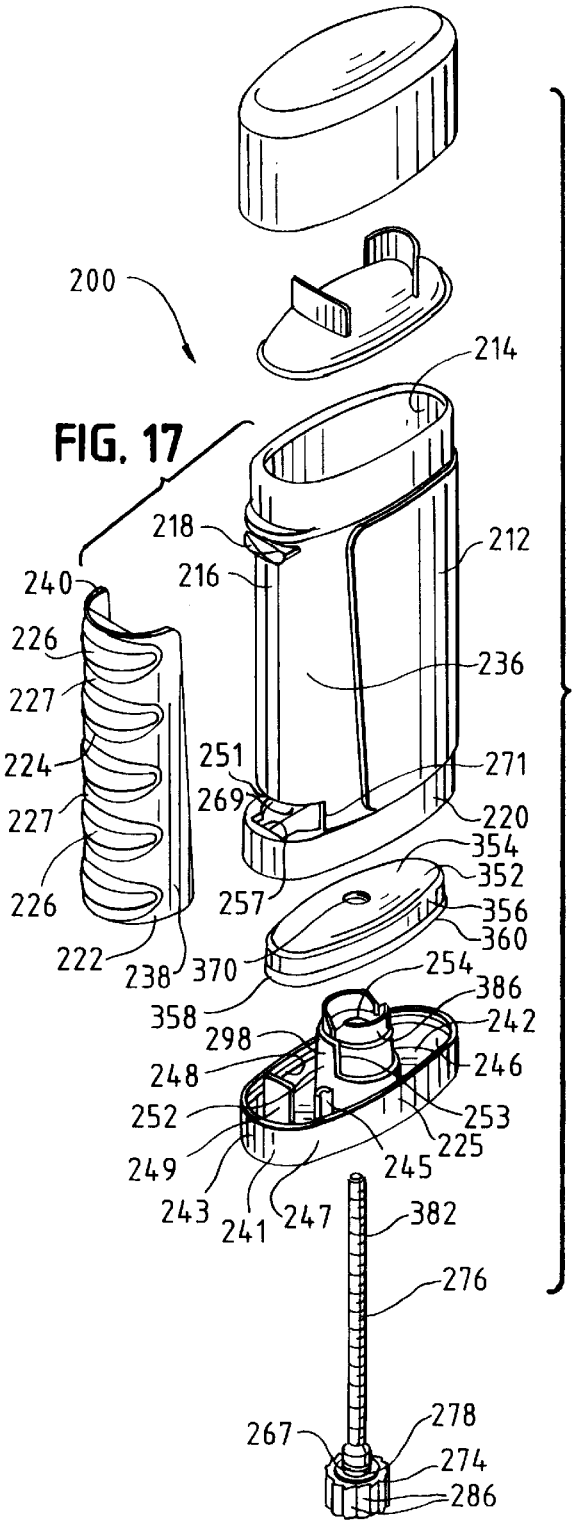
FIG. 17 is an exploded perspective view of an alternate embodiment of the trigger activated product dispenser of the invention, the same being a hinge trigger activated dispenser.
Figure 18:
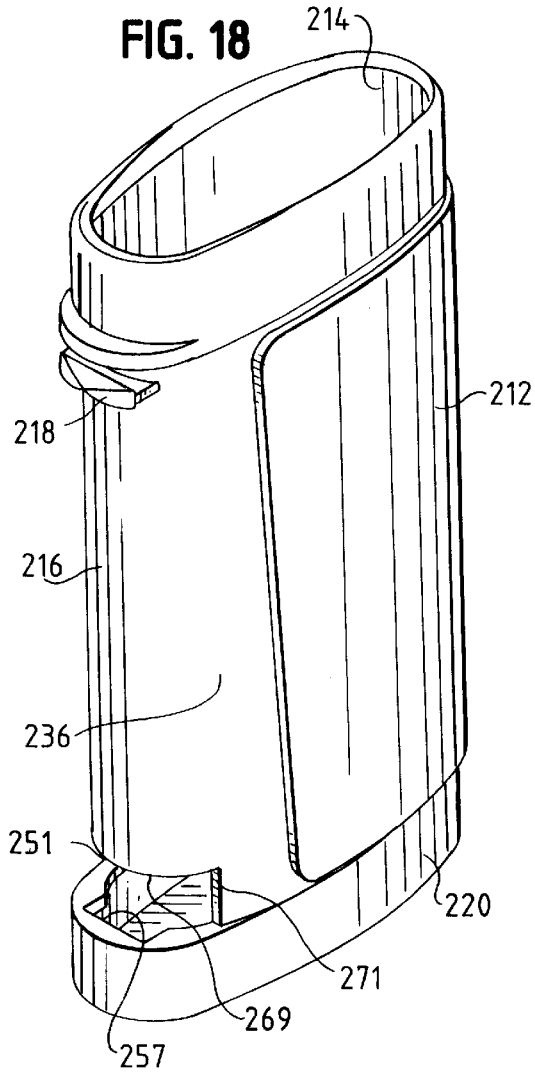
FIG. 18 is a perspective view of the body thereof.

Gear 74 with connected screw axle 76 is provided for receipt within mounting hole 54 of tower 52. Screw collet 78 mates within mounting hole 54 to position, support and retain the gear and screw axle in alignment. As best seen in FIG. 16, the screw collet 78 snaps into the tower hole 54 where it is retained by interaction of the wall 80 of the hole with the collet 78. Retainer ring 140 formed on screw axle 76 locks the screw within the hole 54.

When gear 74 with screw axle 76 is so positioned within tower 52, gear engagement ribs 82, 84 formed on elongate wall portion 64 of spring 62 are disposed for selective engagement with double-acting symmetric teeth 86 of gear 74. Toggle trigger 22 includes ledge 88 formed proximate the lower end 142 thereof between wings 38, 40. A depending nub 92 is formed on ledge 88; nub 92 is received within spring hole 94 formed on end 96 of spring 62 to engage the spring and flex same when the toggle trigger 22 is activated, as explained below. Circumferential wall 98 of tower 52 is formed with a cut-out portion 100 to provide access for ribs 82, 84 to engage the teeth 86 of gear 74 (see FIGS. 13 and 16) when spring 62 is assembled upon base 41.

A product engaging platform or riser 102 is provided for positioning within body 12. Riser 102 includes a top, product engaging, wall 104 from which a circumferential wall 106 depends. The terminal ends 108 of wall 106 engage the inner facing walls 112 of body 12, but are slidable therealong as the riser is moved up or down within the body. A product in solid form (not shown) to be dispensed from the dispenser 10 is placed within body 12 in compartment 13 and rests between top wall 104 of riser 102 and open end 14 of body 12. Seal ring 110 formed along terminal ends 108 of riser circumferential wall 106, may if desired and as illustrated, engage the inner-facing walls 112 of body 12 to prevent leakage of the product from the compartment 13 area within body 12 where the product is retained into the area below riser 102 where spring 62 is positioned.

Riser 102 is formed on the underside 114 of wall 104 with a depending sleeve 116 having a threaded interior passageway 118 which opens at hole 120 on the top wall 104. A pair of alignment tabs 122, 124 are formed at opposite locations of sleeve 116 for alignment with guide slots 126, 128 provided in circular protrusion 146 formed on tower 52 to facilitate assembly of the riser 102 during production of the dispenser 10.

Threads 130 in passageway 118 are formed to mate with screw threads 132 on screw axle 76 when gear 74 and axle 76 is positioned within tower 52 with axle 76 passing through passageway 118. Thus, when gear 74 with screw axle 76 is turned, the screw treads 132 moving against passageway threads 130 impart movement up or down to the riser to move the product retained thereagainst within body 12. End 134 of passageway 118 is formed with a seal surface 136 to seal against screw axle seal surface 138 (see FIG. 16) to prevent leakage of product retained in compartment 13 of body 12 into the area below riser 102 before start of use.

The double-acting symmetric teeth 86 of gear 74 are adapted to be turned in either direction by gear engagement ribs 82, 84 formed on spring 62. Toggle trigger 22 is pivotal against pivot flange 18 between a first rest position (see FIGS. 13 and 16), a second, activated position in which the lower end 142 is retracted toward base 41, and a third activated position in which the upper end 144 is retracted toward open end 14 of body 12. When the upper end 144 of toggle trigger 22 is moved toward open end 14 of body 12, the lower end 142 of the toggle trigger is moved away from base 41 because of the pivot action of the toggle trigger 22 about pivot flange 18.

Figure 13:
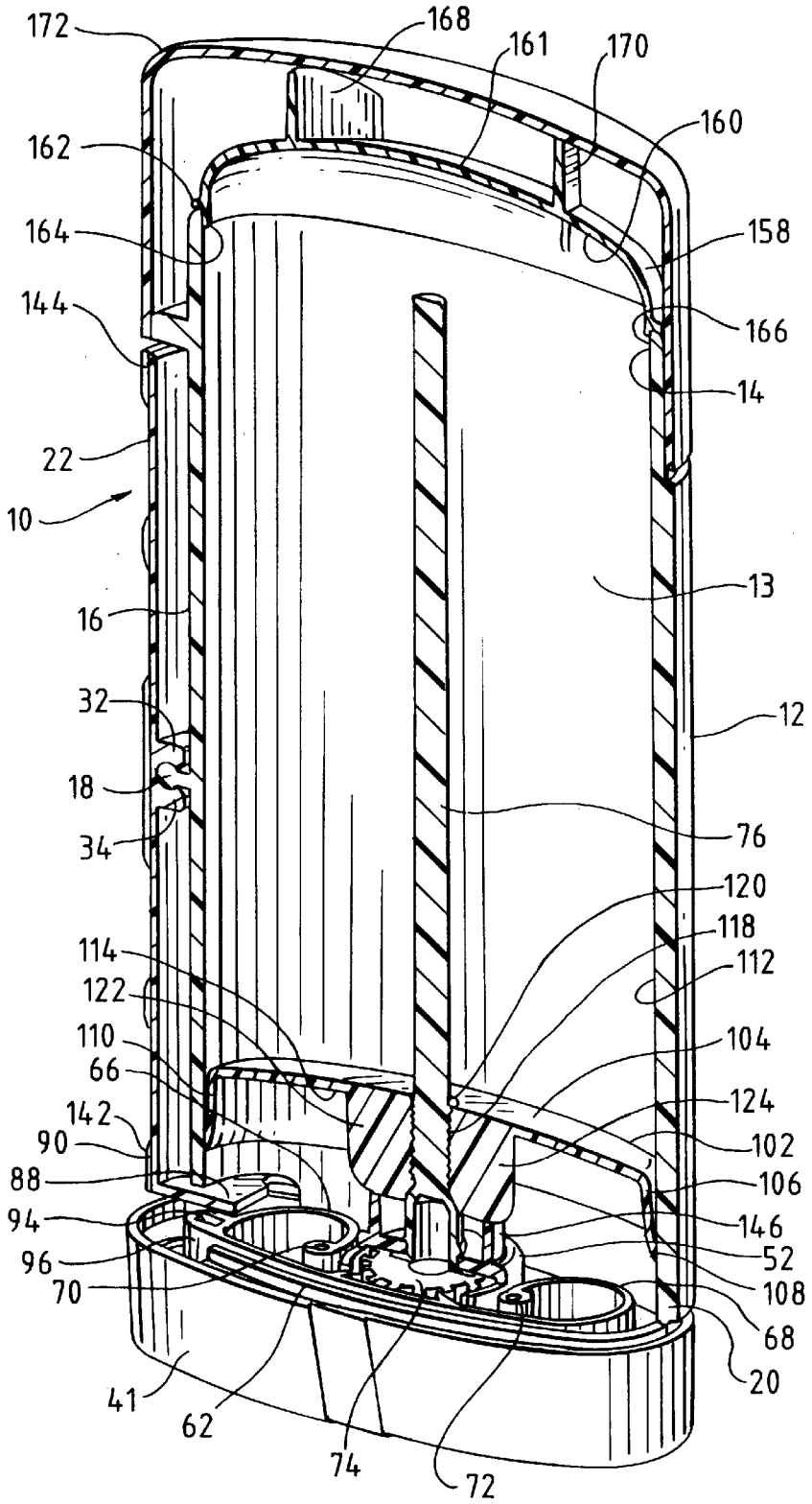
FIG. 13 is a perspective view, partially in section, of the assembled product dispenser shown in FIG. 1.

Spring 62 is disposed in a neutral rest position when toggle trigger 22 is in its first rest position (see FIGS. 13 and 16). In such rest position, neither of ribs 82 or 84 engages the teeth 86 of gear 74. The spring action of spring 62 renders it self-centering, and simultaneously returns toggle trigger 22 to its first rest position by reason of engagement of depending nub 92 within spring hole 94 of spring 62.

When it is desired to advance or dispense product from dispenser 10, the user wraps his hand about body 12 with the digits or palm of the user's hand resting against external surface 24 of toggle trigger 22. The user then depresses his large finger digit (or palm) to cause the toggle trigger to pivot about pivot flange 18 which causes the upper end 144 to move toward open end 14 of body 12 and the lower end 142 to move away from base 41, thereby pulling nub 92 against hole 94 to flex spring 62 in a direction that causes rib 84 to engage gear teeth 86 and move the gear one notch. Resultantly, screw axle 76 turns to cause riser 102 to move upwardly a short distance and thereby move or advance the product retained within body 12 toward open end 14 to be dispensed therefrom. When the user relaxes his digit to release toggle trigger 22, spring 62 returns to its neutral position, moving toggle trigger 22 also to its first rest position. Trigger wings 38, 40 move along recessed area 36 of body 12 to guide the toggle trigger 22 during forward and return movement.

When it is desired to cause the product retained within body 12 to be withdrawn back into the body, such as when an excessive amount of product has been advanced toward the open end 14 in the manner described above, the user depresses his little finger digit (or palm) to cause the toggle trigger to pivot about pivot flange 18 which causes the lower end 142 to move toward base 41, thereby pushing nub 92 against hole 94 to flex spring 62 in a direction that causes rib 82 to engage gear teeth 86 and move the gear one notch in the direction opposite to that first described above. Resultantly, screw axle 76 turns in the opposite direction to that described above to cause riser 102 to move downwardly a short distance and thereby retract the product back into the body 12.

The advancing or retracting operation of the riser 102 can be performed in consecutive actions to advance or retract the product one or multiple notches of gear 74 and screw axle 76, as desired. Access opening 148 in body 12 permits access of trigger ledge 88 with depending nub 92 into the body and the access opening has side walls 150, 152 which engage against trigger notches 154, 156 of ledge 88 to act as a positive stop for toggle trigger 22 when the lower end 142 is moved toward base 41.

Dispenser 10 can be provided with a contour cap 158 having a generally domed configuration, the underside 160 of which is usable to mold a contour shape onto the top of a solid product to be retained within body 12. A lip seal 162 formed along the peripheral edge 164 of cap 158 inserts into edge 166 of top open end 14 of body 12 and seals thereagainst to close said open end. Finger grasping tabs 168, 170 are provided on the top side 161 of contour cap 158 to be grasped by a user to lift the contour cap 158 off of open end 14 to allow use of the dispenser. A cover 172 is provided to protect the contents of dispenser 10 when not in use. Cover ribs 174 formed on the inner facing surface 176 thereof touch down against the open end 14 of body 12 to position the cover 172. Cover snap ribs 178 lock into recesses 180 provided in body 12 proximate to open end 14 to removably secure the cover to the body.

Figure 19:
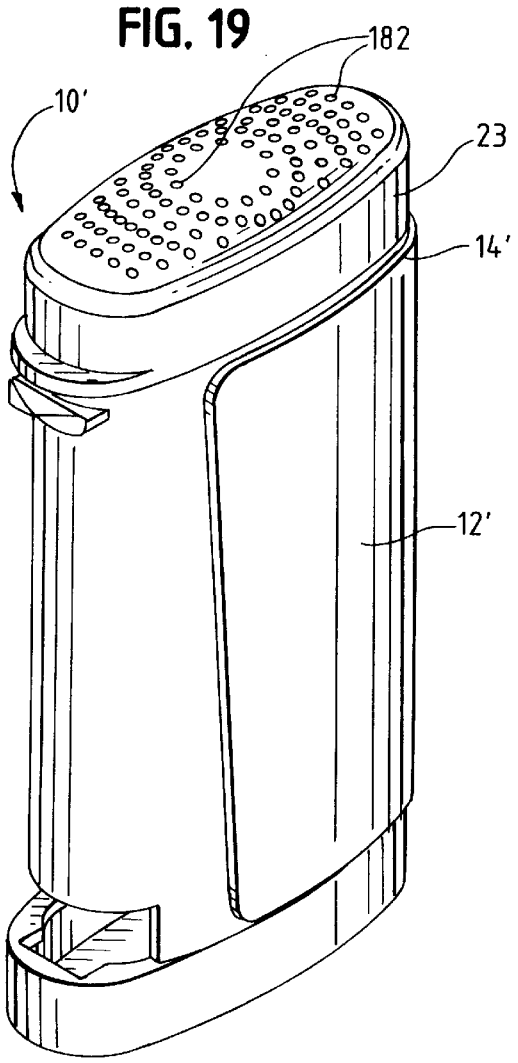
FIG. 19 is a perspective view of an alternate embodiment of the body thereof having a pattern of holes proximate the opening thereof to dispense liquids, gels, creams or pastes therefrom.
Figure 20:
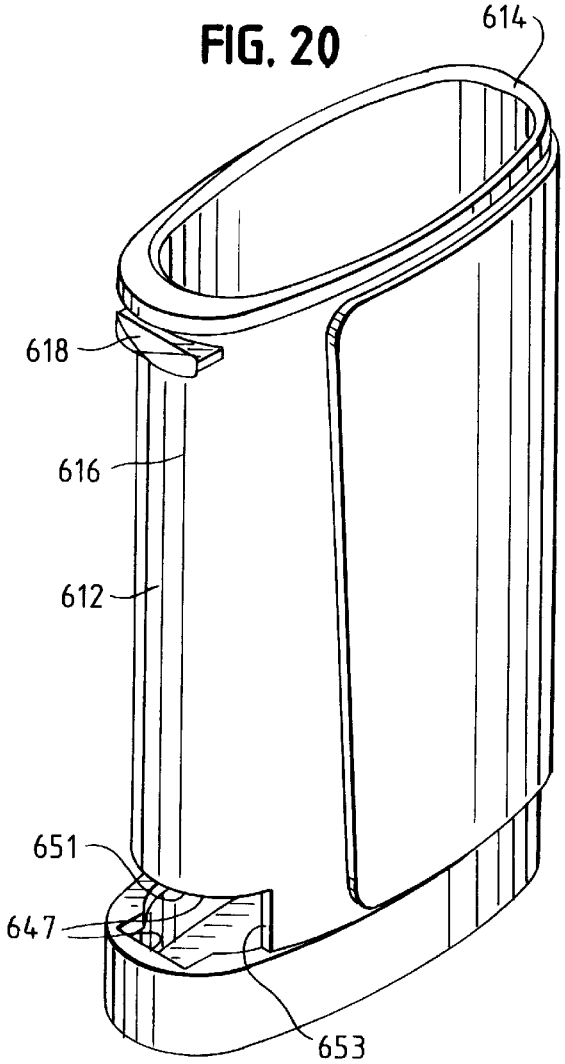
FIG. 20 is a perspective view of a still further alternate embodiment of the body thereof adapted to accept a product-retaining cartridge therein.
Figure 21:
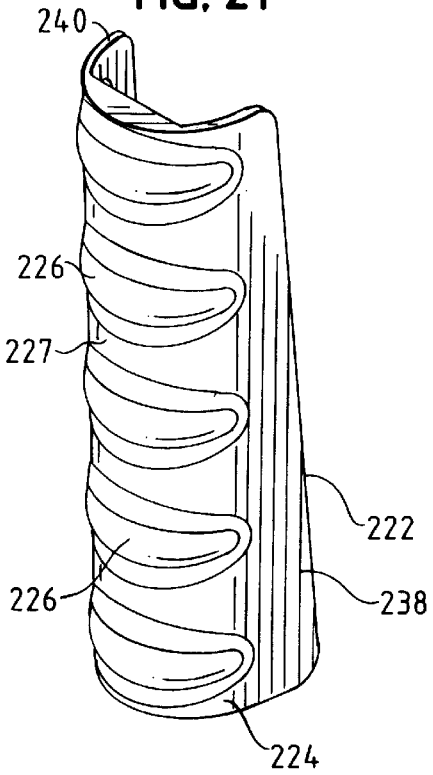
FIG. 21 is a front perspective view of the hinge trigger of the product dispenser shown in FIG. 17.
Figure 22:
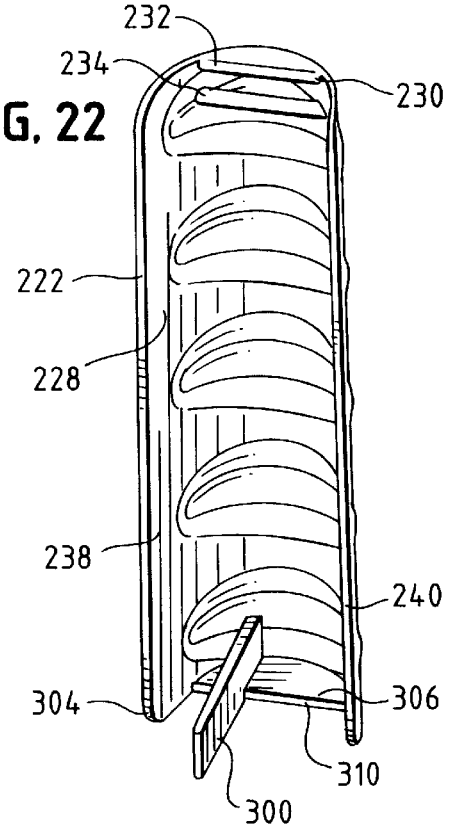
FIG. 22 is a rear perspective view thereof.
Figure 23:
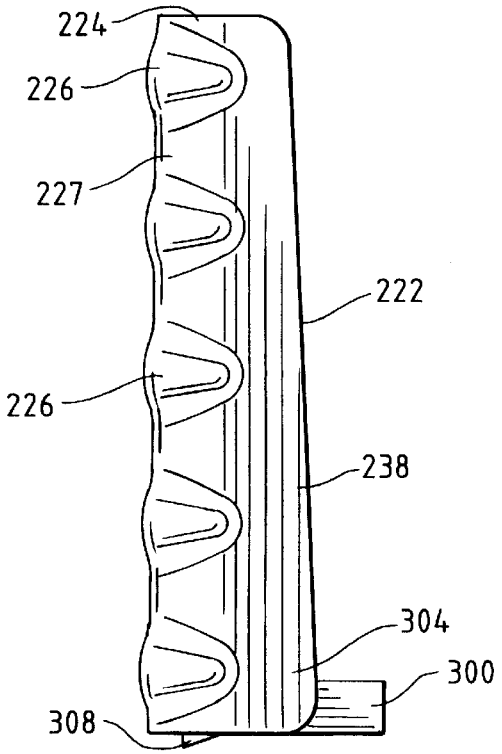
FIG. 23 is a side elevational view thereof.
Figure 24:
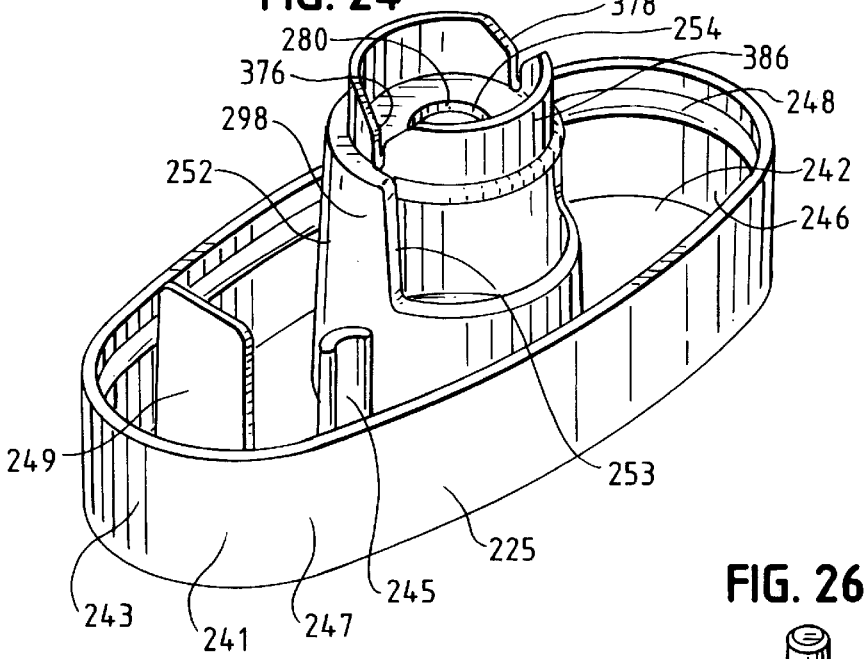
FIG. 24 is a perspective view of the base of the hinge trigger activated dispenser.
Figure 25:
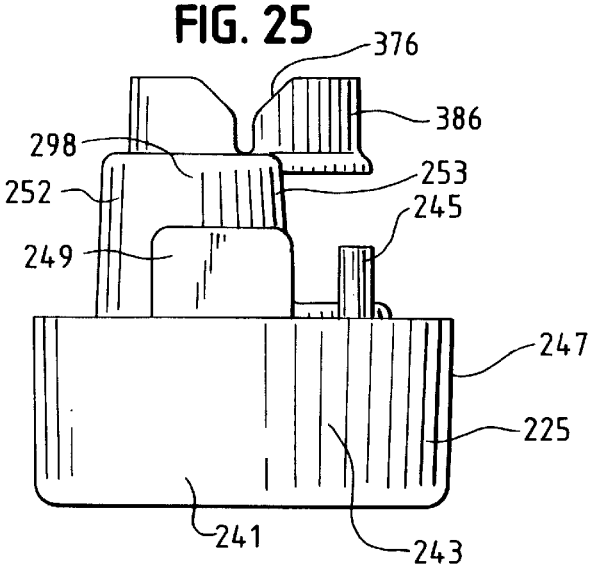
FIG. 25 is an end side elevational view of the base shown in FIG. 24.
Figure 26:
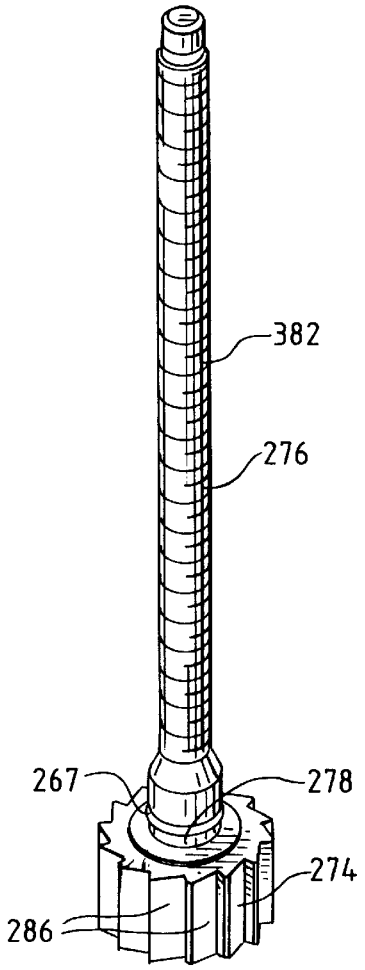
FIG. 26 is a perspective view of the gear and screw axle of the product dispenser shown in FIG. 17.
Figure 27:
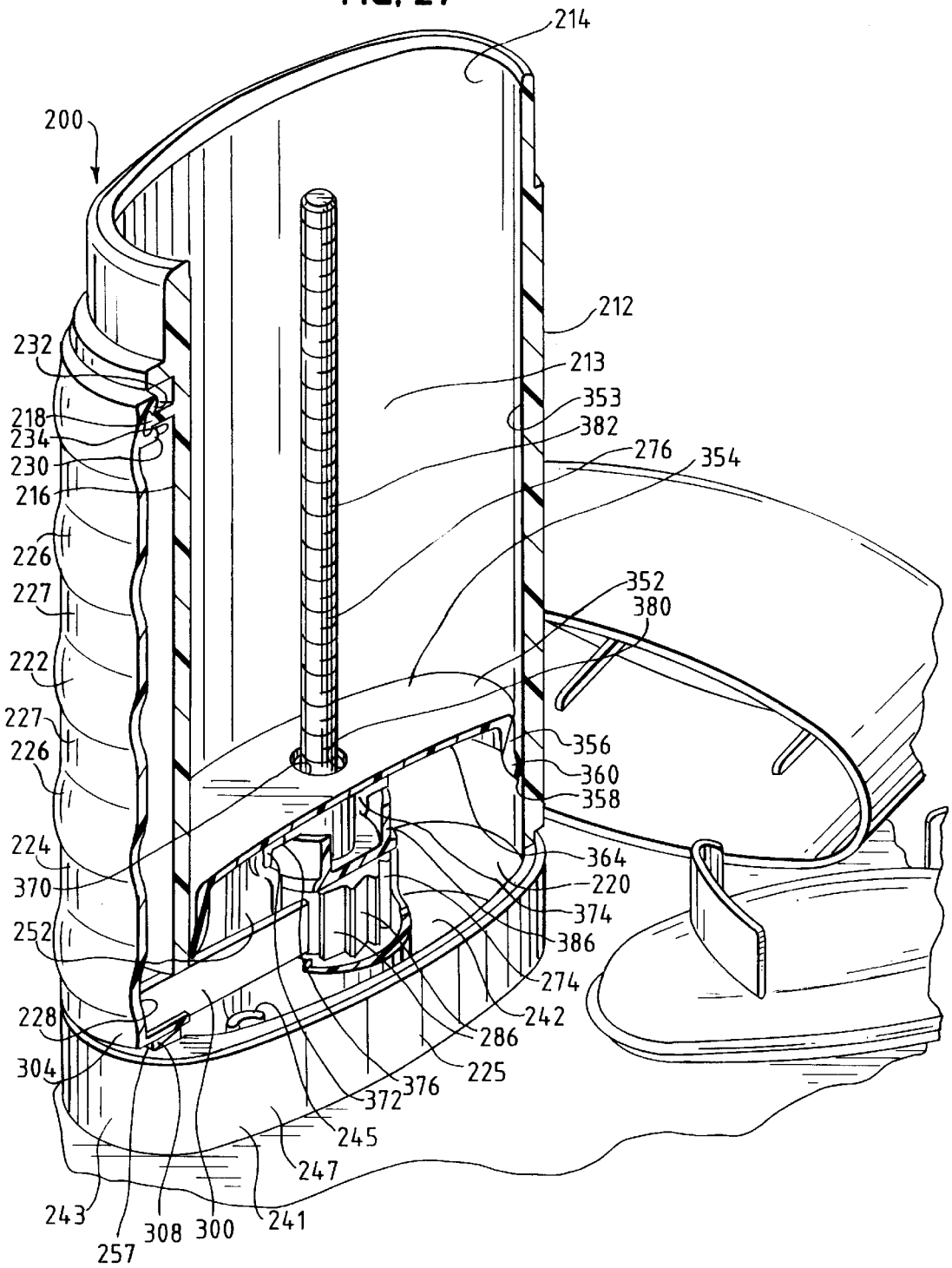
FIG. 27 is a perspective view, partially in section, of the assembled product dispenser shown in FIG. 17, with the cover and contour cap thereof shown removed but placed adjacent to the assembled dispenser.
Figure 28:
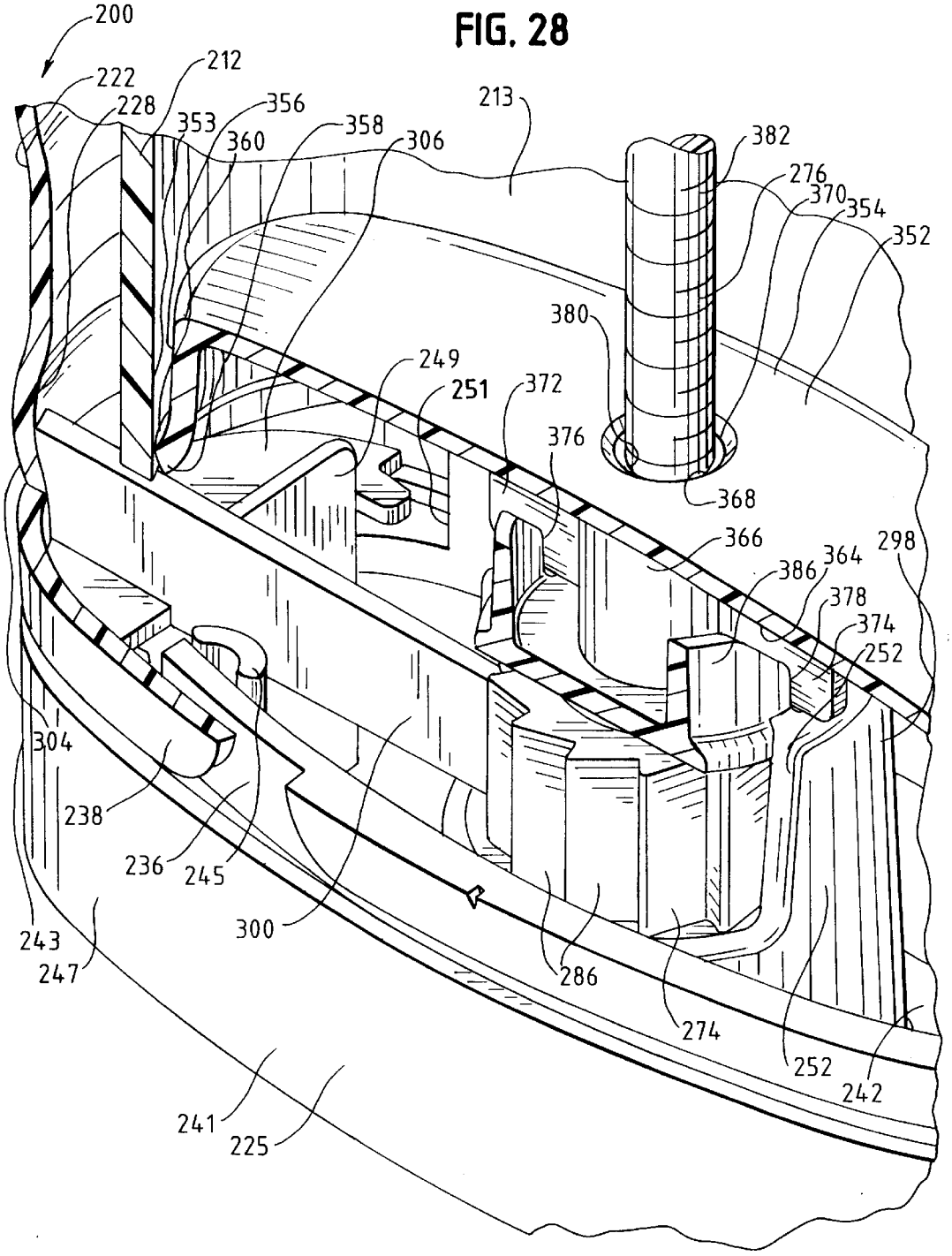
FIG. 28 is an enlarged, sectional, fragmentary view of the inside lower portion of the product dispenser shown in FIG. 17.
Figure 29:
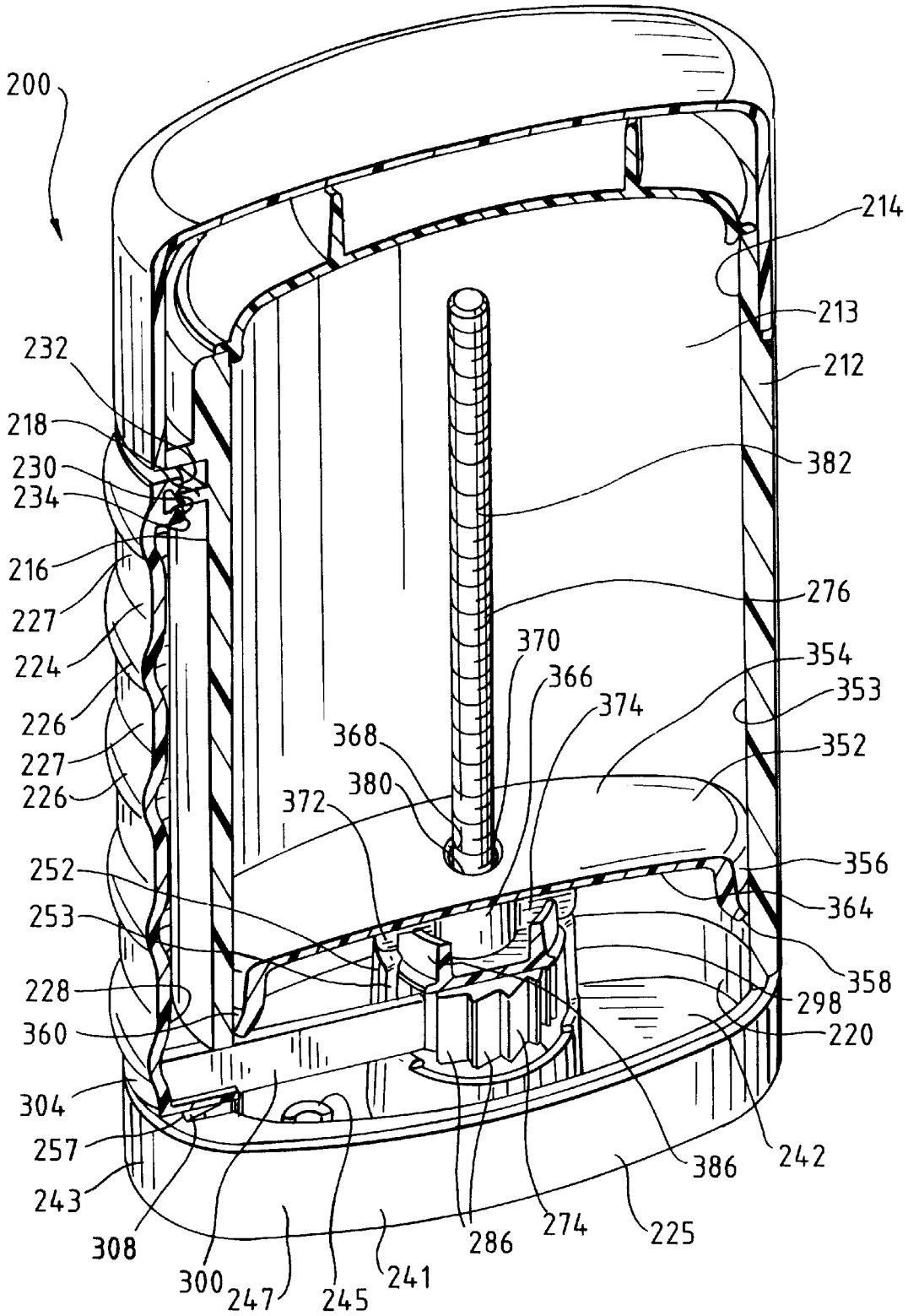
FIG. 29 is a perspective view, partially in section, of the assembled product dispenser shown in FIG. 17.
Figure 30:
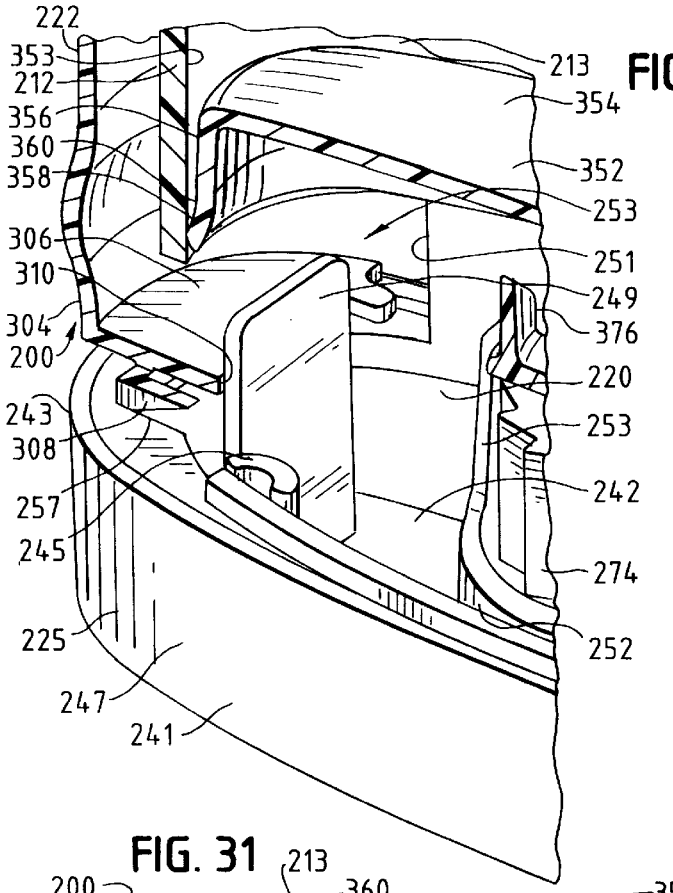
FIG. 30 is an enlarged, fragmentary, partially sectional view of the inner lower portions of the product dispenser shown in FIG. 17.

As an alternative to dispenser 10 having body 12 with open end 14 for dispensing of product in sold form, container 10' seen in FIG. 19 having body 12' may be provided having a dispensing end 14' provided with a covering 23 formed with any pattern of openings, such as holes 182 or slots to conveniently dispense product in liquid, gel, cream or paste form from body 12'. In all other respects, the constructional and operational features of the present invention are the same.

The invention also contemplates a product dispenser 200 which utilizes a hinge trigger 222 as an alternative to toggle trigger 22 used with dispenser 10. Referring to FIGS. 17–18 and 21–31, the constructional details of the dispenser 200 and related parts are the same as those described for dispenser 10, except as described in detail as follows.

Dispenser 200 includes a body 212 having open end 214 through which a deodorant or any other appropriate product is dispensed. Body 212 is provided on the external surface 216 thereof with a pivot flange 218 which extends from the surface 216 at a location proximate to open end 214. Hinge trigger 222 may have an external surface 224 with raised portions 226, between which are spaces 227 to comfortably fit the digits of a user's hand.

Hinge trigger 222 is adapted for positioning against the external surface 216 of body 212, which is formed with a recessed area 236 to accommodate generally U-shaped trigger wings 238, 240 of hinge trigger 222. The interior surface 228 of hinge trigger 222 (see FIG. 22) which is positioned against surface 216 of body 212 is formed with a pivot flange engaging clip 230 having a pair of parallel spaced snap members 232, 234 which snap-fit upon pivot. flange 218 to secure hinge trigger 222 to body 212.

Figure 32:
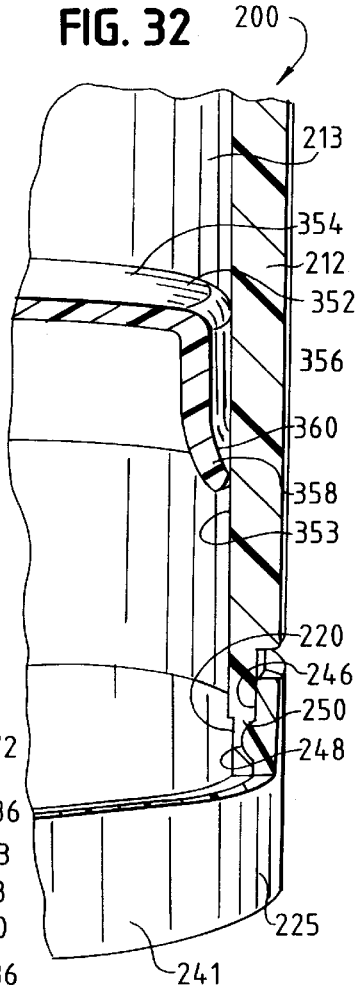
FIG. 32 is an enlarged, fragmentary, partially sectional view of the inner lower portions of the product dispenser located opposite to those portions shown in FIGS. 30 and 31.
Figure 31:
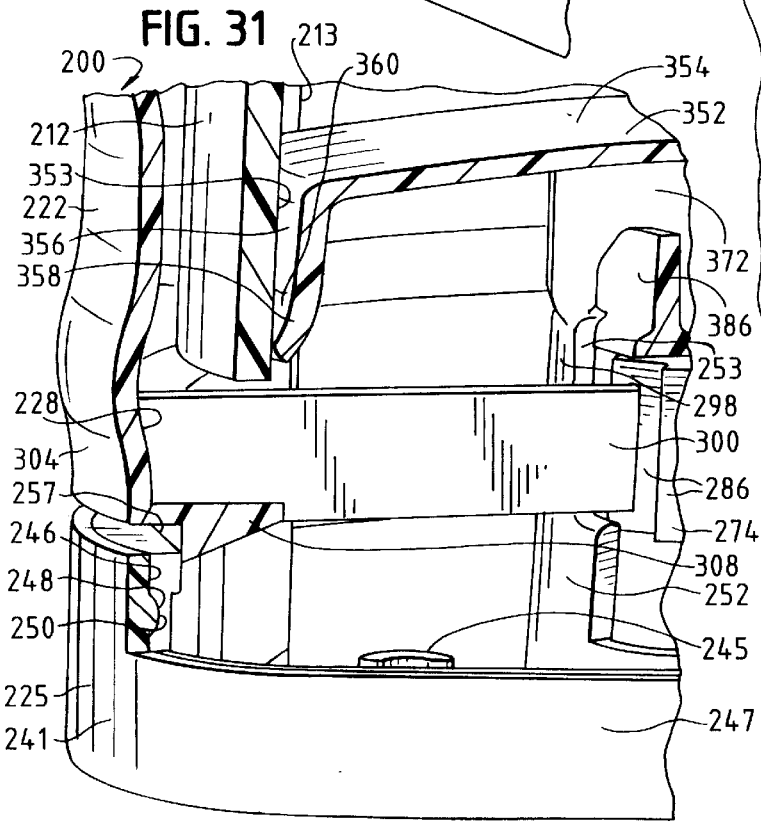
FIG. 31 is a view similar to that of FIG. 30, but taken from a slightly different angle and showing the gear advancing finger associated with the hinge trigger.
Figure 33:
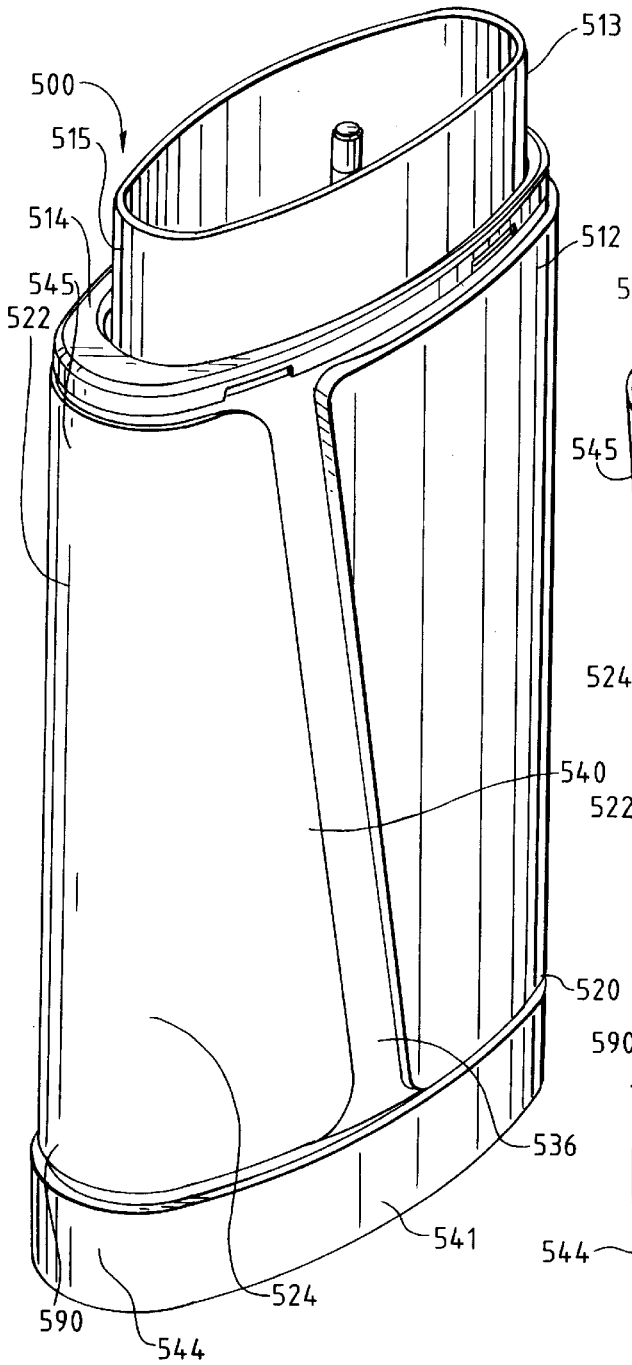
FIG. 33 is a perspective view of a further alternate embodiment of the trigger activated product dispenser of the invention, the same being a toggle trigger activated dispenser with a removable product-retaining cartridge having end tabs in assembly therewith.
Figure 34:
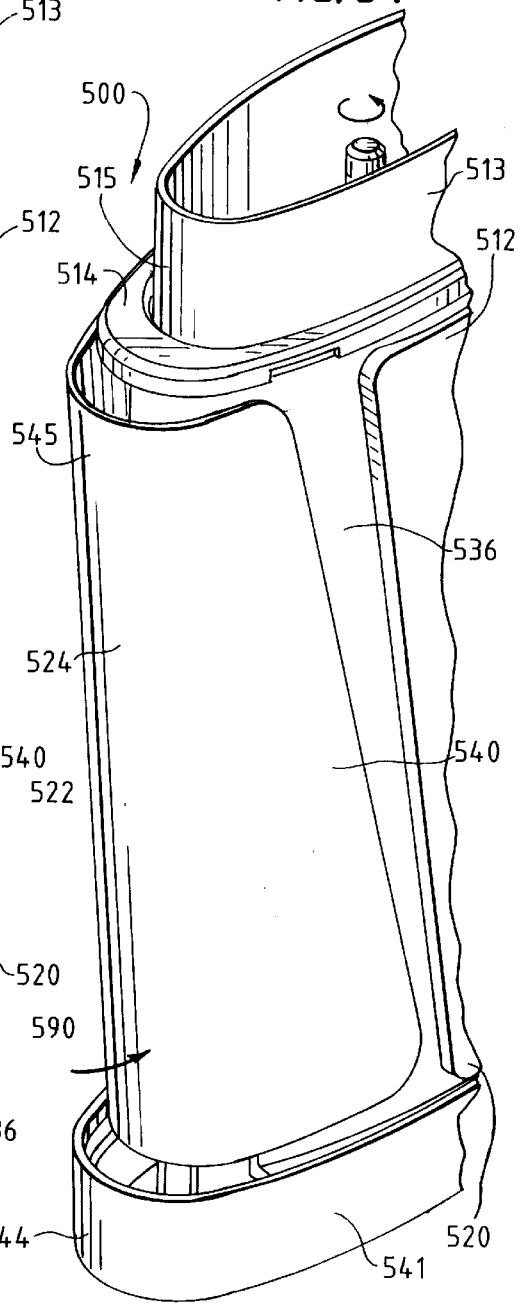
FIG. 34 is a perspective view similar to that of FIG. 33, but showing the trigger bottom moved to the cartridge release position.
Figure 35:
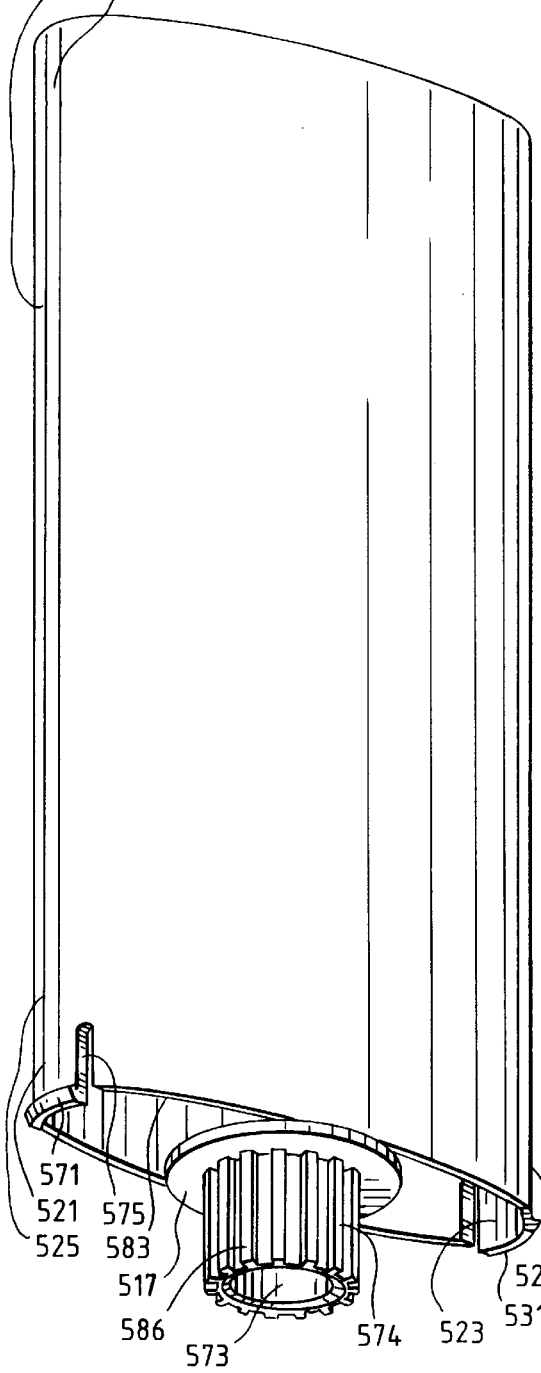
FIG. 35 is an underside perspective view of a cartridge having end tabs for use with the dispenser shown in FIG. 33.
Figure 36:
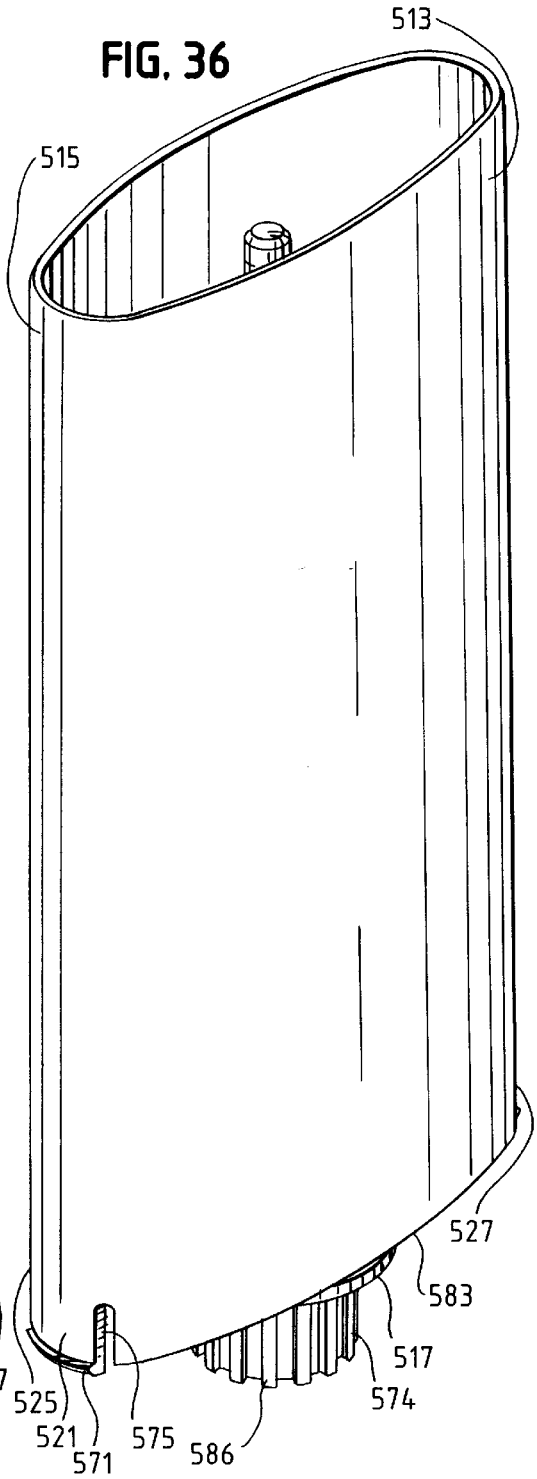
FIG. 36 is a top side perspective view of the cartridge shown in FIG. 35.

Base 241 is provided for attachment to body 212 to close end 220 thereof which is disposed opposite end 214. Base 241 is of generally cup-shaped configuration with a bottom wall 242 and a circumferentially disposed upstanding end wall 225. End wall 225 is formed on the inner-facing surface 246 thereof with a. projecting rib 248 to be matingly engaged within circumferential groove 250 formed on body 212 for snap-fit attachment of the base 241 upon the body 212 (see FIGS. 31 and 32).

An upstanding, centrally-located tower 252 is formed on bottom wall 242 of base 241 and includes a mounting hole 254 for receipt of the gear 274 and connected screw axle 276 in a manner to be described hereafter.

Base 241 includes spring arm 249 upstanding from bottom wall 242 proximate to end 243. Finger guide 245 is positioned upstanding upon bottom wall 242 proximate to side wall 247.

Gear 274 with connected screw axle 276 is provided for receipt within mounting hole 254 of tower 252. Screw collet 278 mates within mounting hole 254 to position, support and retain the gear and screw axle in alignment. Screw collet 278 snaps into the tower hole 254 where it is retained by interaction of the wall 280 of the hole with the collet 278. Retainer ring 267 formed on screw axle 276 locks the screw within the hole 254.

Hinge trigger 222 includes protruding finger 300 formed on the interior surface 228 thereof proximate the lower end 304. Ledge 306 is positioned between wings 238, 240 of the hinge trigger also proximate to the lower end 304, and includes a depending catch 308 for a purpose to be described. Access opening 269 in body 212 permits access of ledge 306 with finger 300 into body 212.

Ledge 306 has a lead edge 310 (see FIG. 30) which abuts spring arm 249 when hinge trigger 222 is assembled upon body 212. Finger guide 245 guides finger 300 during assembly of trigger 222 upon base 212, and during movement thereof.

When gear 274 with screw axle 276 is positioned within tower 252, finger 300 on hinge trigger 222 engages the single acting angled teeth 286 of gear 274. Lead edge 310 of ledge 306 pushes against spring arm 249 and ledge 306 acts as a positive stop against the sides 251, 271 of access opening 269. Circumferential wall 298 of tower 252 is formed with a cut-out portion 253 to provide access for finger 300 to engage teeth 286 of gear 274. Lip 257 on access opening 269 acts as a lock for catch 308 on the hinge trigger when the same is assembled on body 212.

A product engaging platform or riser 352 is provided for positioning within body 212. Riser 352 includes a top, product engaging, wall 354 from which a circumferential wall 356 depends. The terminal ends 358 of wall 356 engage the inner facing walls 353 of body 212, but are slidable therealong as the riser is moved within the body. A product in solid form (not shown) to be dispensed from the dispenser 200 is placed within body 212 in compartment 213 and rests between top surface 354 of riser 352 and open end 214 of body 212. Seal ring 360 formed along terminal ends 358 of riser circumferential wall 356 engage the inner-facing walls 353 of body 212 to prevent leakage of the product from the compartment area 213 within body 212 where the product is retained into the area below riser 352 where finger 300 is positioned.

Riser 352 is formed on the underside 364 of wall 354 with a depending sleeve 366 having a threaded interior passageway 368 which opens at hole 370 on the top wall 354. A pair of alignment tabs 372, 374 are formed at opposite locations of sleeve 366 for alignment with guide slots 376, 378 provided in circular protrusion 386 formed on tower 252 to facilitate assembly of the riser 352 during production of the dispenser 200.

Threads 380 in passageway 368 are formed to mate with screw threads 382 on screw axle 276 when gear 274 and axle 276 is positioned within tower 252 with axle 276 passing through passageway 368. Thus, when gear 274 with screw axle 276 is turned, the screw treads 382 moving against passageway threads 380 impart movement to the riser to move the product retained thereagainst within body 212.

The single-acting angled teeth 286 of gear 274 are adapted to be turned in one direction only by gear engagement finger 300 formed on hinge trigger 222. Hinge trigger 222 is pivotal against pivot flange 218 between a first rest position (see FIGS. 30 and 31), and a second, activated position in which the lower end 304 is retracted toward base 241.

When it is desired to advance or dispense product from dispenser 200, the user wraps his hand about body 212 with the digits of the user's hand resting against external surface 224 of hinge trigger 222. The user then depresses a finger digit or digits to cause the hinge trigger to pivot about pivot flange 218 which causes the lower end 304 of trigger 222 to move toward end 220 of body 212, thereby pushing ledge 306 against spring arm 249 and finger 300 to engage gear teeth 286 and move the gear one notch. Resultantly, screw axle 276 turns to cause riser 352 to move upwardly a short distance and thereby move or advance the product retained within compartment 213 of body 212 toward open end 214 to be dispensed therefrom. When the user relaxes his finger digits to release hinge trigger 222, spring arm 249 returns to its neutral position, moving ledge 306 and hinge trigger 222 also to its first rest position. Trigger wings 238, 240 move along recessed area 236 of body 212 to guide the hinge trigger 222 during forward and return movement.

The advancing operation of the riser 352 can be performed in consecutive actions to advance the product one or multiple notches of gear 274 and screw axle 276, as desired.

The invention also contemplates a product dispenser 500 in which the body portion 512 is adapted for use with a product retaining cartridge 513 which is removably positionable within the body 512, thereby enabling the dispenser 500 to be re-usable with another cartridge 513, such as after product in a prior cartridge has been completely dispensed, or also at any time. Referring to FIGS. 33 through 55, the constructional details of the dispenser 500 and related parts are the same as those previously described, except as referenced in detail hereafter.

The product dispenser 500 is similar in construction to the toggle trigger dispenser 10 shown in FIGS. 1–16. The body portion 512 has an open end 514 through which the cartridge 513 which retains a desired product can be inserted for positioning within body 512.

Body 512 is provided on the external surface 516 thereof with a pivot flange 518 which extends from said surface 516 at a location spaced approximately mid-length the distance between open end 514 and the opposite end 520 thereof. A toggle trigger 522 is adapted for positioning against the external surface 516 of body 512. External surface 516 of body 512 is formed with a recessed area 536 to accommodate generally U-shaped trigger wings 538, 540 of toggle trigger 522 which act as guides for the toggle trigger. The interior surface 528 of toggle trigger 522 which is positioned against surface 516 of body 512 is formed with a pivot flange engaging clip 530 having a pair of parallel spaced snap members 532, 534 which snap-fit upon pivot flange 518 to secure toggle trigger 522 to body 512.

Base 541 is provided for attachment to body 512 to close end 520 thereof which is disposed opposite open end 514. Base 541 is of generally cup-shaped configuration with a bottom wall 542 and a circumferentially disposed upstanding end wall 544. End wall 544 is formed on the inner-facing surface 546 thereof with a projecting rib 548 to be matingly engaged within circumferential groove 550 formed on body 512 for snap-fit attachment of the base 541 upon the body 512.

An upstanding, centrally-located boss 552 is formed on bottom wall 542 of base 541 for positioning within alignment passageway 573 formed within gear 574 and connected screw axle 576 in a manner to be described hereafter. A pair of upstanding mounting posts 558, 560 are formed on the bottom wall 542 positioned on opposite sides of boss 552.

Spring 562, which is identical to spring 62 (see FIG. 6), is constructed from resilient material and is provided for positioning upon base 541 resting on bottom wall 542. Spring 562 includes an elongate main wall portion 564 with oppositely disposed generally circular terminal portions 566, 568, each of which is formed with a respective mounting hole 570, 572 to facilitate mounting of the spring within base 541 by engagement of mounting posts 558, 560 within respective mounting holes 570, 572.

Product retaining cartridge 513 is provided for removable positioning within body 512. Cartridge 513 has the same cross-sectional configuration as that of dispenser body 512 so that cartridge 513 is slidably positionable within body 512. Gear 574 and connected screw axle 576 is mounted within cartridge 513 by engagement of axle 576 within threaded passageway 519 formed in riser 502 positioned within cartridge 513. Alignment passageway 573 formed within gear 574 is positioned over boss 552 when cartridge 513 is positioned within body 512. Guard disc 517 is formed upon gear 574 proximate its connection with axle 576 and engages the lower edge 583 of cartridge 513 to prevent the gear from moving upwardly into cartridge 513 when riser 502 is being pulled downwardly during operation of the dispenser 500.

When cartridge 513 is positioned within body 512 with gear alignment passageway 573 positioned over boss 552, gear engagement ribs 582, 584 (see FIG. 40) formed on elongate wall portion 564 of spring 562 are disposed for selective engagement with double-acting symmetric teeth 586 of gear 574. Toggle trigger 522 includes ledge 588 formed proximate the lower end 590 thereof between wings 538, 540. A depending nub 592 is formed on ledge 588; nub 592 is received within spring hole 594 formed on end 596 of spring 562 to engage the spring and flex same when the toggle trigger 522 is activated.

The product engaging platform or riser 502 positioned within body 512 includes a top, product engaging, wall 504 from which a circumferential wall 506 depends. The terminal ends 508 of wall 506 engage the inner facing walls 587 of cartridge 513, but are slidable therealong as the riser is moved up or down within the cartridge. A product in solid form (not shown) to be dispensed from the dispenser 500 is placed within cartridge 513 and rests between top surface 504 of riser 502 and open end 581 of cartridge 513.

Riser 502 is formed on the underside 529 of wall 504 with a depending sleeve 539 having a threaded interior passageway 519 which opens at hole 591 on the top wall 504. Threads 593 in passageway 519 are formed to mate with screw threads 569 on screw axle 576 when gear 574 and axle 576 is positioned upon boss 552 with axle 576 passing through passageway 519. Thus, when gear 574 with screw axle 576 is turned, the screw threads 569 moving against passageway threads 593 impart movement up or down to the riser to move the product retained thereagainst within cartridge 513. End 579 of passageway 519 is formed with a seal surface 549 to seal against screw axle seal surface 559 (see FIGS. 37–39 and 42) to prevent leakage of product retained in cartridge 513 into the area below riser 502.

Figure 39:
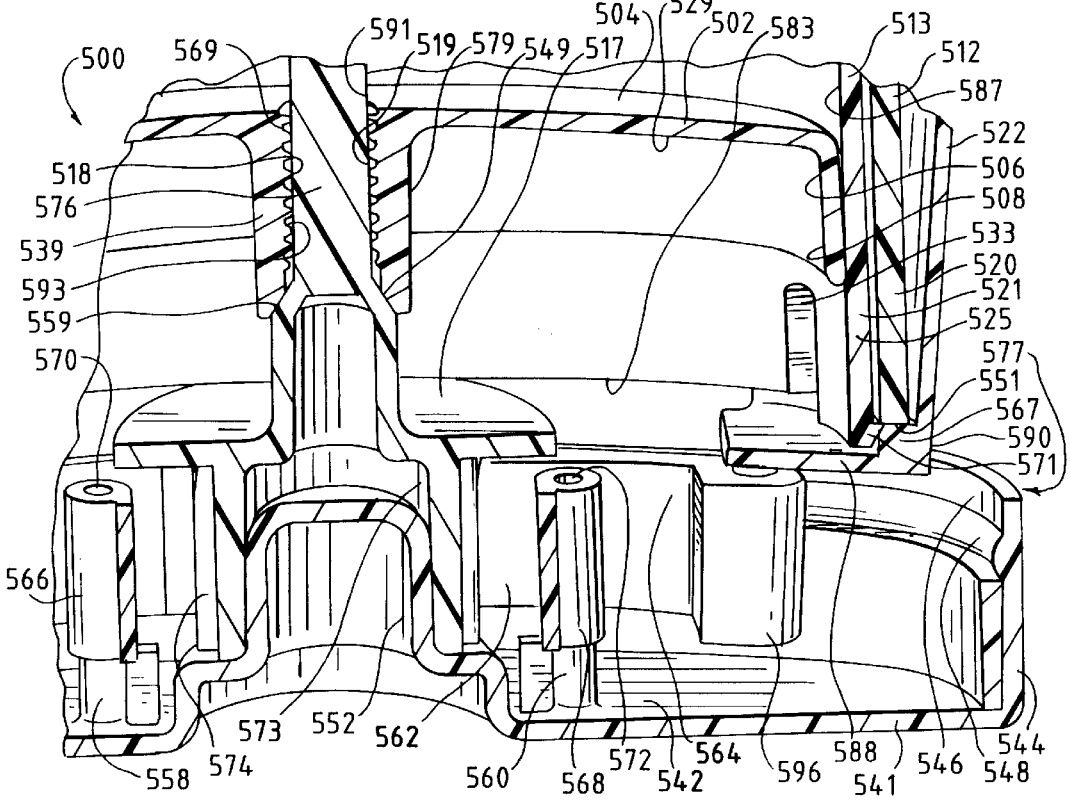
FIG. 39 is a view similar to that shown in FIG. 38, but illustrating the trigger bottom moved to the cartridge release position.
Figure 40:
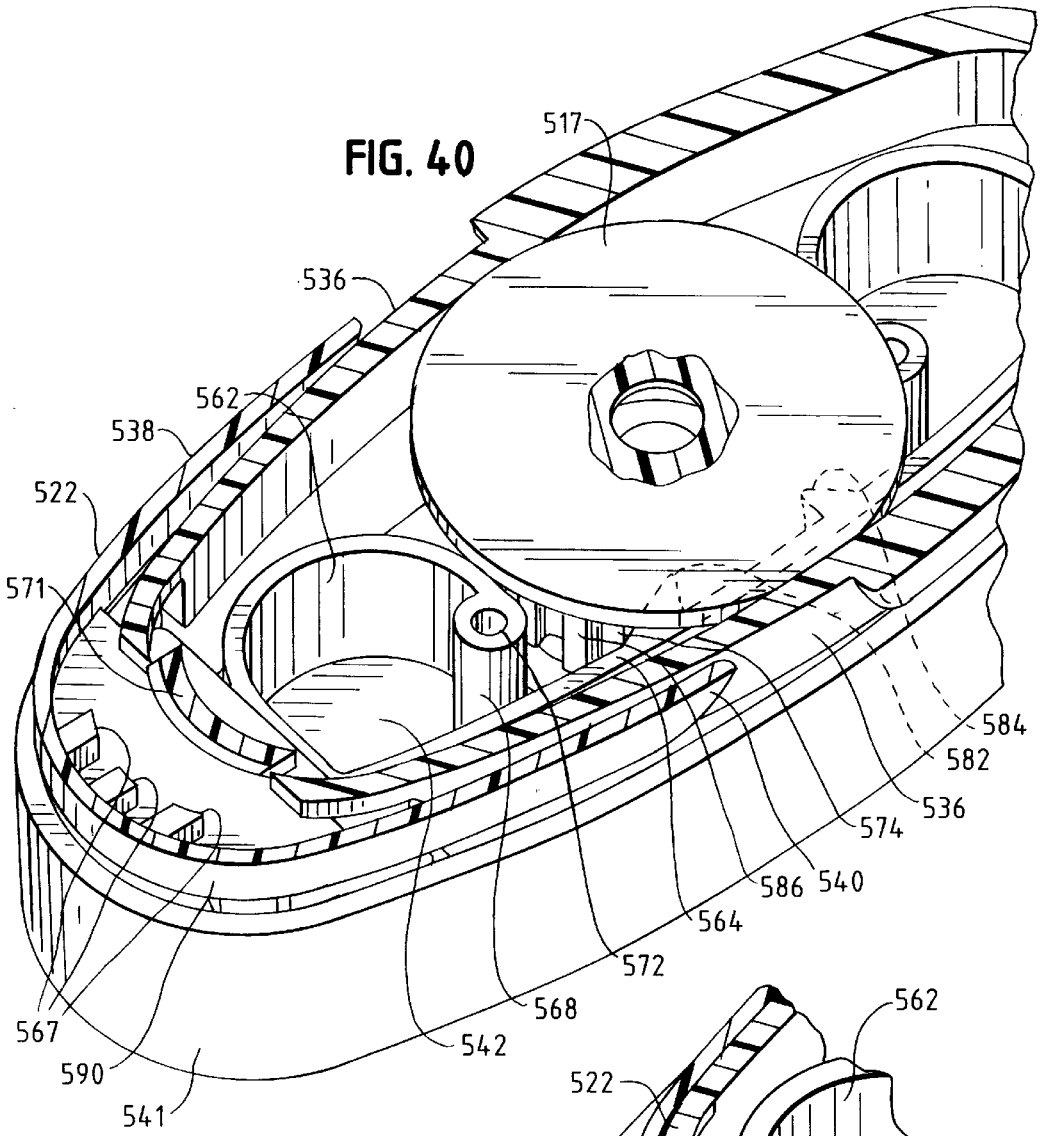
FIG. 40 is a sectional view, partially fragmentary, taken through the lower portion of the dispenser shown in FIG. 37.
Figure 41:
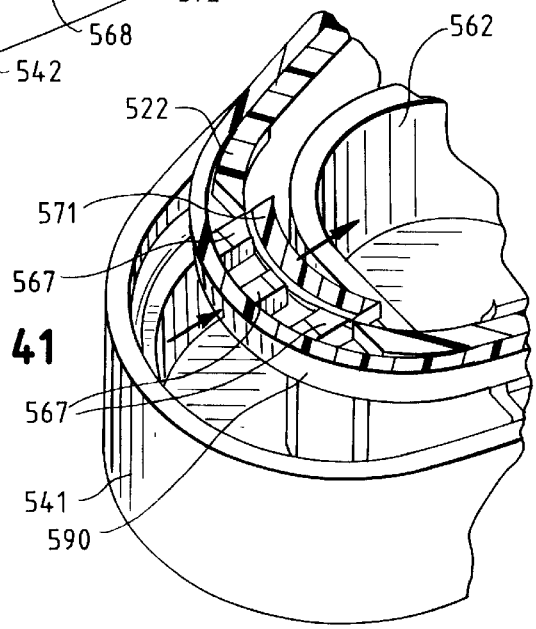
FIG. 41 is an enlarged fragmentary view of a portion of dispenser shown in FIG. 40, but illustrating the trigger bottom moved to the cartridge release position.
Figure 42:
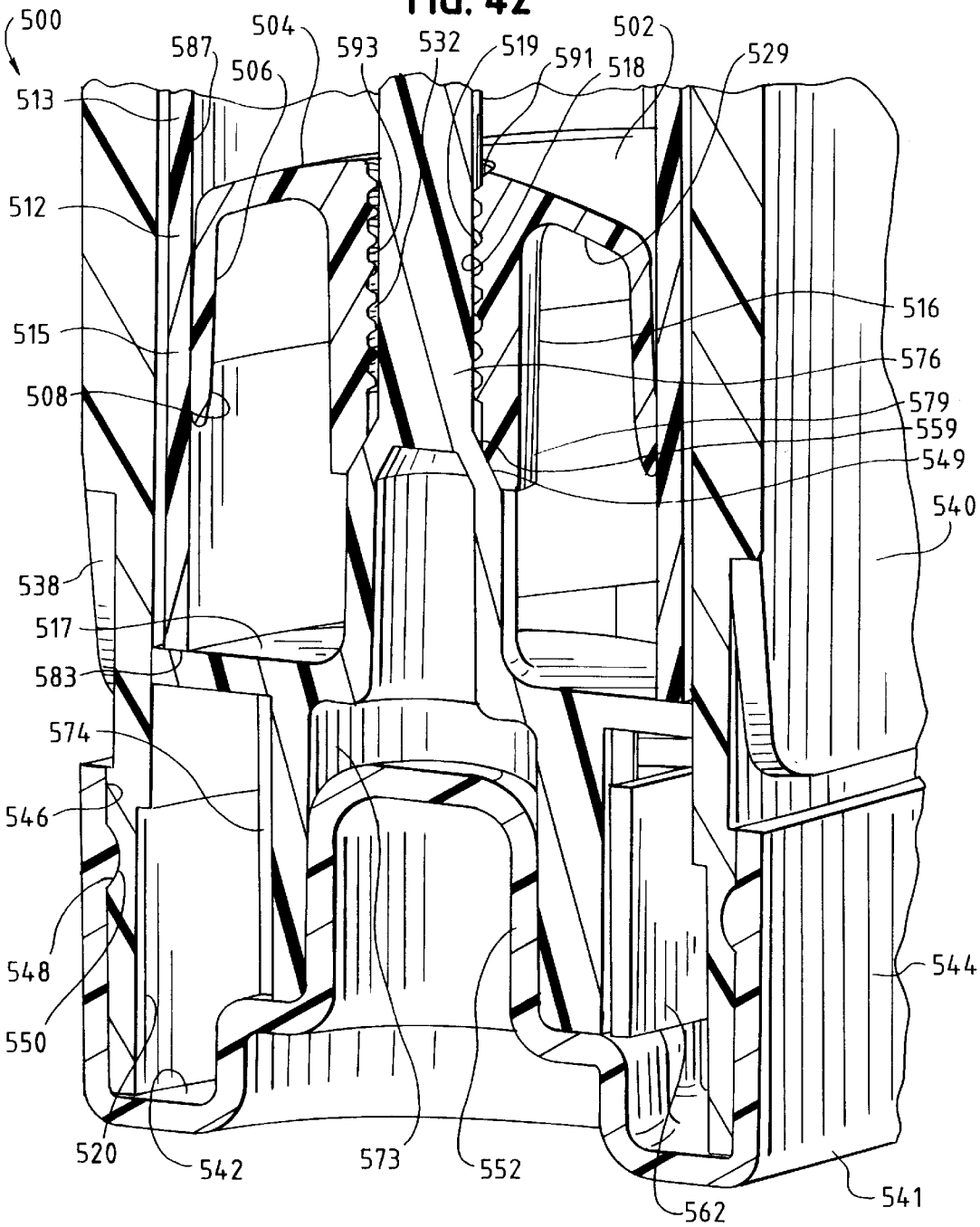
FIG. 42 is an enlarged, fragmentary sectional view taken through the bottom portion of the dispenser shown in FIG. 37.
Figure 43:
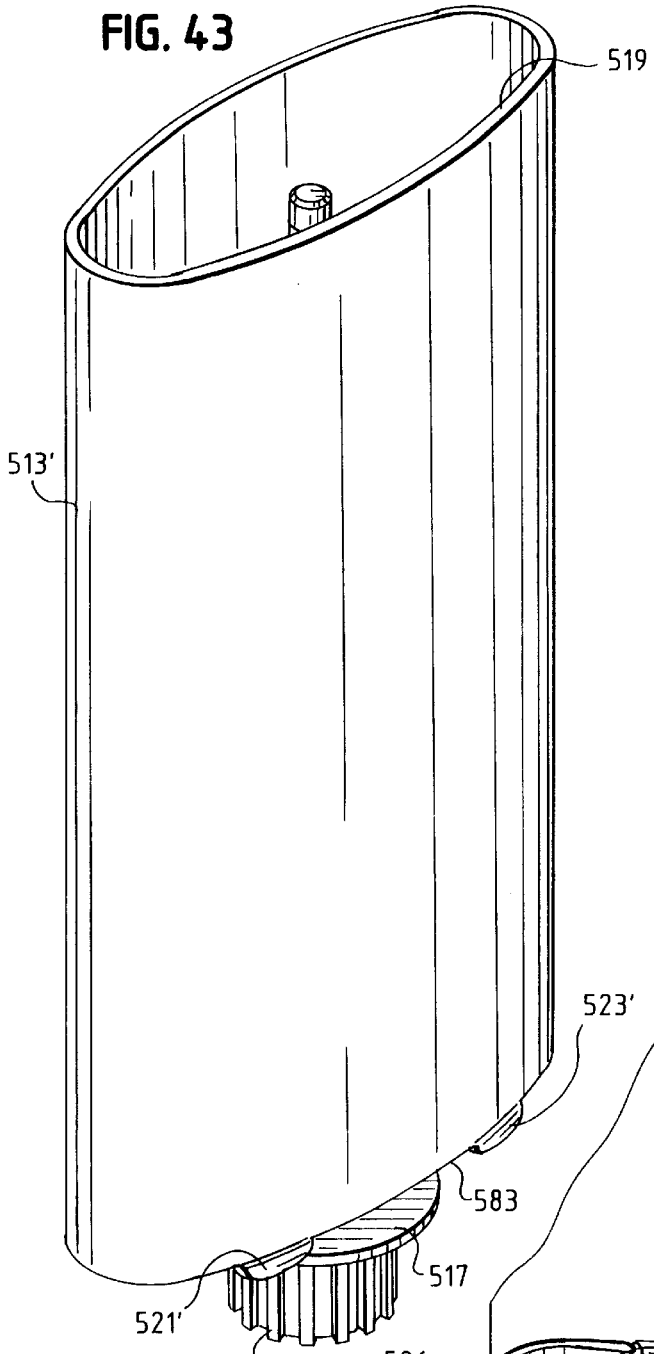
FIG. 43 is a perspective view of an alternate embodiment of the removable product-retaining cartridge of the invention, the same having side tabs.
Figure 44:
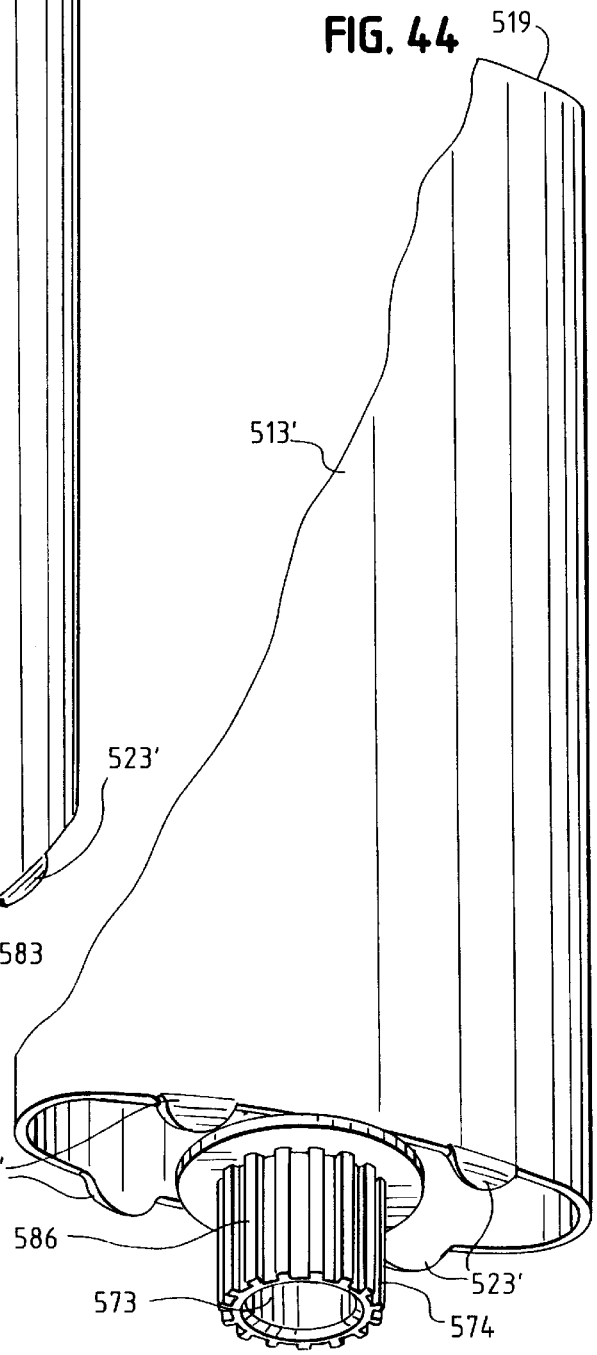
FIG. 44 is a partially fragmentary, underside perspective view of the cartridge shown in FIG. 43.
Figures 45, 46, 47:
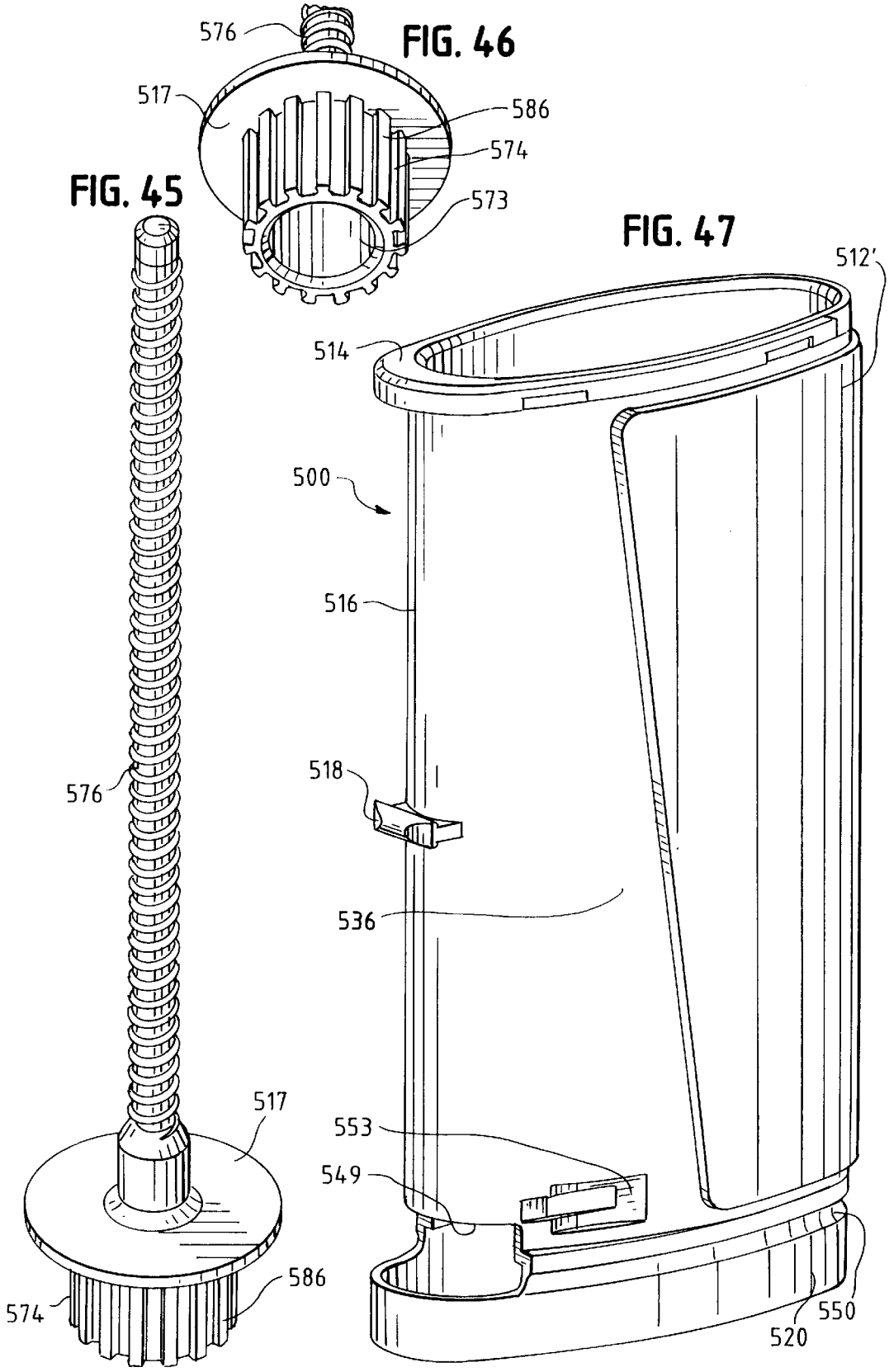
FIG. 45 is a perspective view of the gear and screw axle portion of the cartridge shown in FIGS. 35 and 43.
FIG. 46 is a fragmentary, underside perspective view of the gear and screw axle shown in FIG. 45.
FIG. 47 is a perspective view of the body portion of the toggle trigger activated dispenser within which the cartridge having side tabs shown in FIG. 43 is received.
Figure 48:
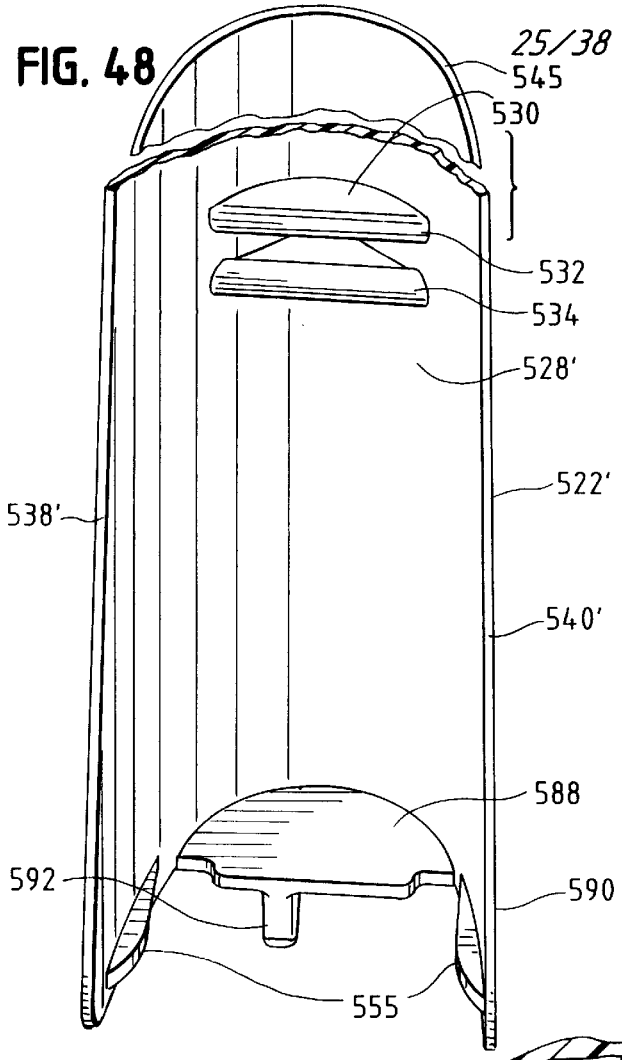
FIG. 48 is a rear perspective view of the toggle trigger for use with the body shown in FIG. 47.
Figure 49:
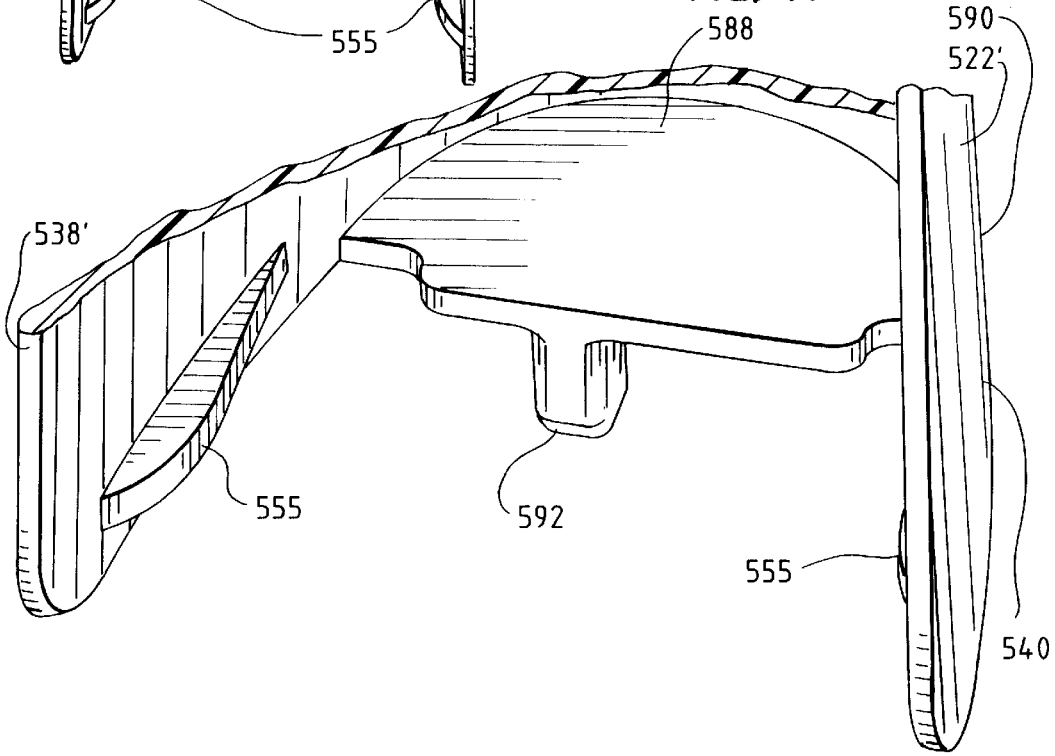
FIG. 49 is an enlarged fragmentary view of the lower portion of the trigger shown in FIG. 48.
Figure 50:
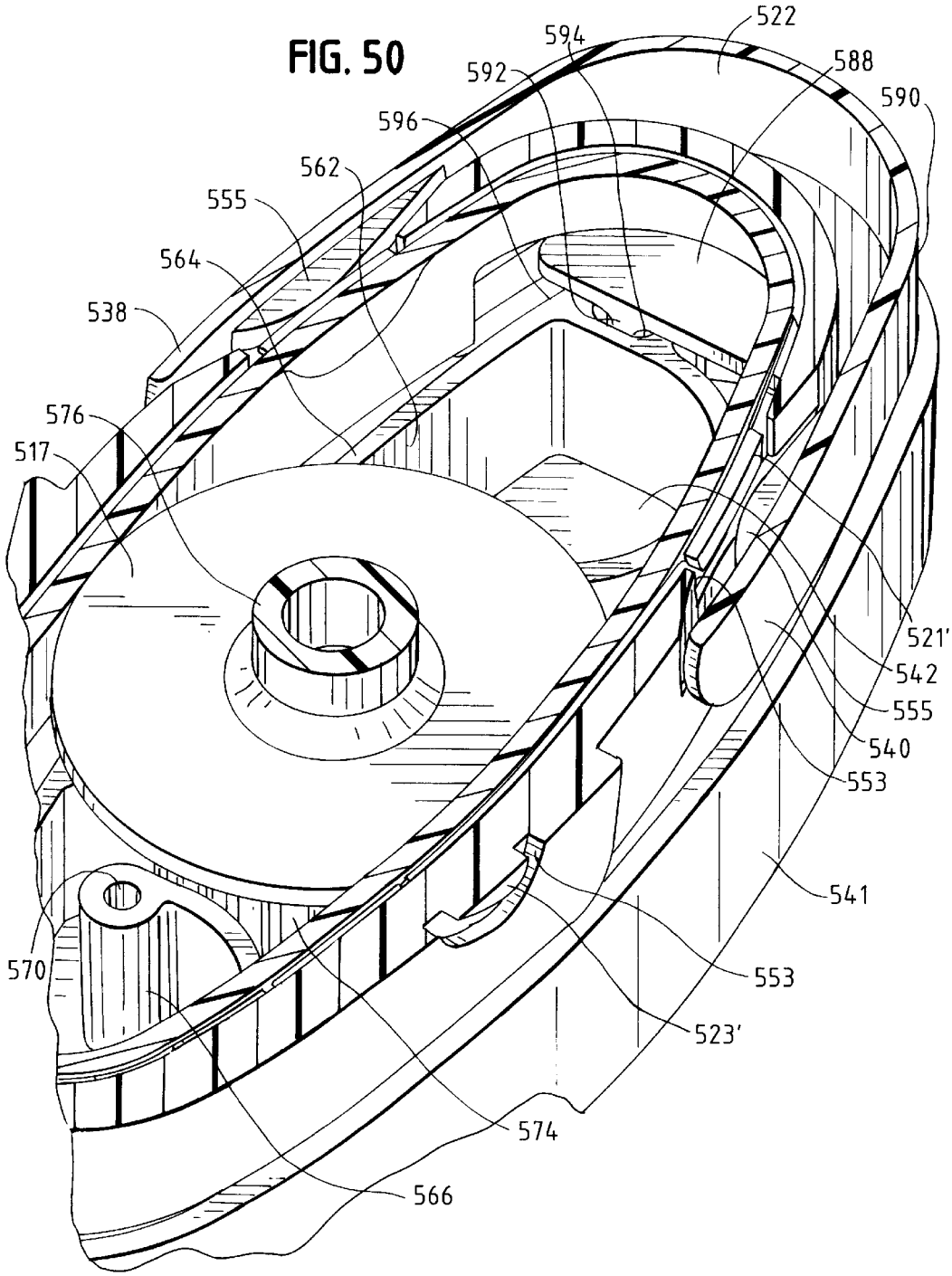
FIG. 50 is a sectional view, partially fragmentary, taken through the lower portion of the dispenser shown in FIG. 47 with the cartridge shown in FIG. 43 assembled therein and the trigger shown in FIG. 48 assembled thereon.
Figure 51:
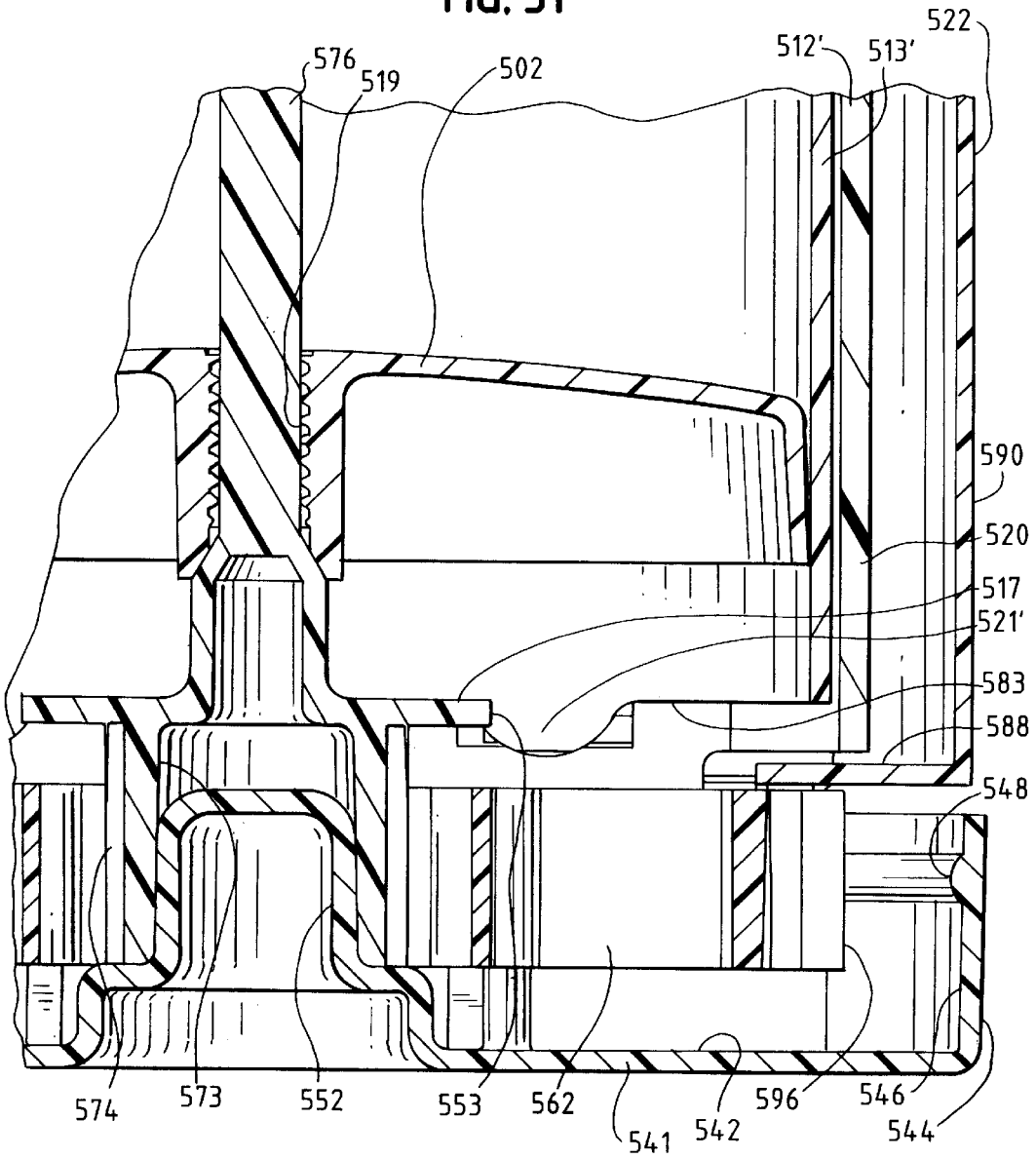
FIG. 51 is an enlarged, fragmentary, partially sectional view taken through the lower corner of the dispenser assembled as in FIG. 50.

The double-acting symmetric teeth 586 of gear 574 are adapted to be turned in either direction by gear engagement ribs 582, 584 formed on spring 562 (see FIG. 40). Toggle trigger 522 is pivotal against pivot flange 518 between a first rest position (see FIGS. 37 and 38), a second, activated position in which the lower end 590 is retracted toward base 541 (see FIG. 39), and a third activated position in which the upper end 545 is retracted toward open end 514 of body 512. When the upper end 545 of toggle trigger 522 is moved toward open end 514 of body 512, the lower end 590 of the toggle trigger is moved away from base 541 because of the pivot action of the toggle trigger 522 about pivot flange 518.

Figure 37:
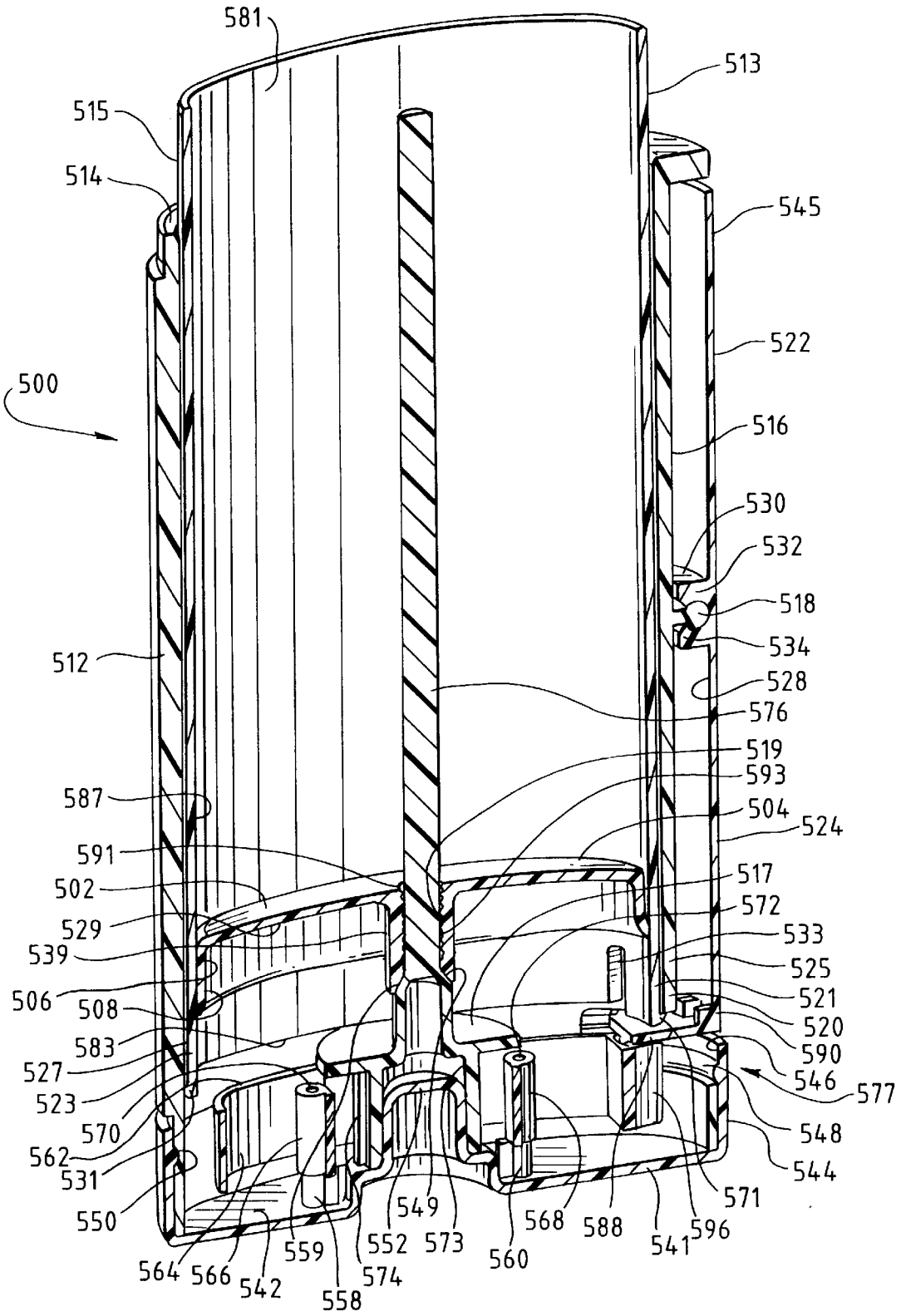
FIG. 37 is a longitudinal sectional view taken through the dispenser shown in FIG. 33.
Figure 38:
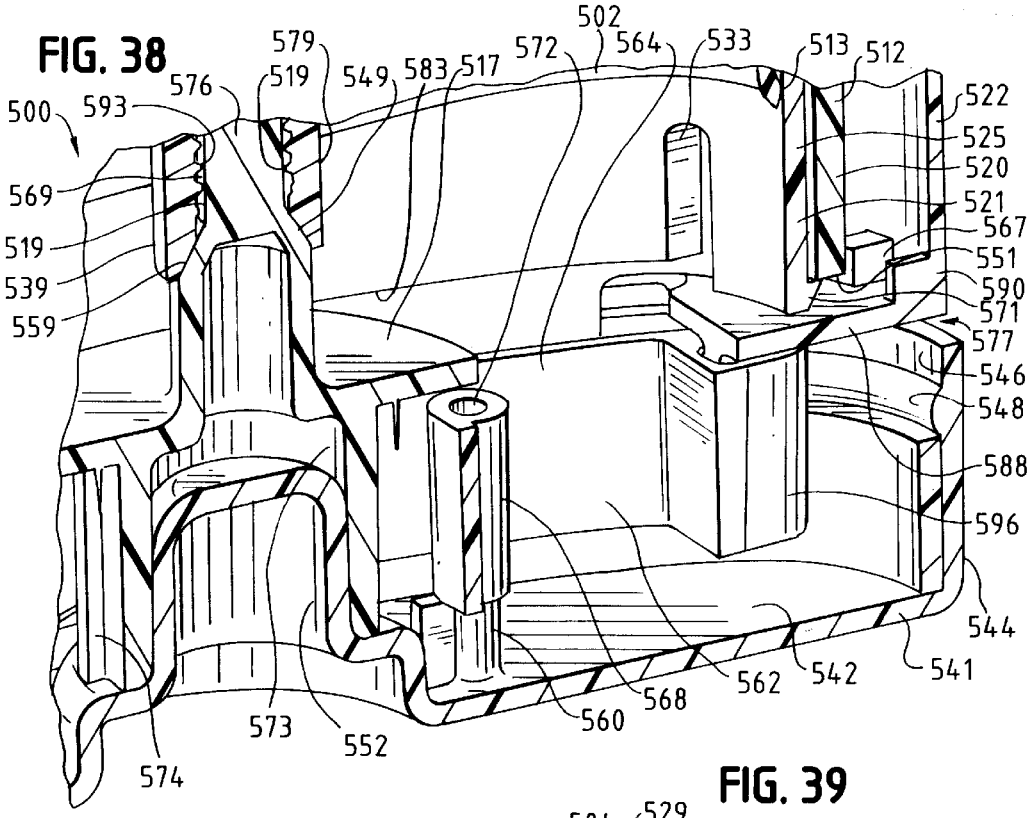
FIG. 38 is an enlarged fragmentary, view taken through the lower right-hand corner of the dispenser shown in FIG. 37.

Spring 562 is disposed in a neutral rest position when toggle trigger 522 is in its first rest position (see FIGS. 37 and 38). In such rest position, neither of ribs 582 or 584 engages the teeth 586 of gear 574. The spring action of spring 562 renders it self-centering, and simultaneously returns toggle trigger 522 to its first rest position by reason of engagement of depending nub 592 within spring hole 594 of spring 562.

When it is desired to advance or dispense product from dispenser 500, the user wraps his hand about body 512 with the digits of the user's hand resting against external surface 524 of toggle trigger 522. The user then depresses his large finger digit to cause the toggle trigger to pivot about pivot flange 518 which causes the upper end 545 to move toward open end 514 of body 512 and the lower end 590 to move away from base 541, thereby pulling nub 592 against hole 594 to flex spring 562 in a direction that causes rib 584 to engage gear teeth 586 and move the gear one notch. Resultantly, screw axle 576 turns to cause riser 502 to move upwardly a short distance and thereby move or advance the product retained within cartridge 513 toward open end 581 to be dispensed therefrom. When the user relaxes his digit to release toggle trigger 522, spring 562 returns to its neutral position, moving toggle trigger 522 also to its first rest position. Trigger wings 538, 540 move along recessed area 536 of body 512 to guide the toggle trigger 522 during forward and return movement.

When it is desired to cause the product retained within cartridge 513 to be withdrawn back in the cartridge, such as when an excessive amount of product has been advanced toward the open end 581 in the manner described above, the user depresses his little finger digit to cause the toggle trigger to pivot about pivot flange 518 which causes the lower end 590 to move toward base 541, thereby pushing nub 592 against hole 594 to flex spring 562 in a direction that causes rib 582 to engage gear teeth 586 and move the gear one notch in the direction opposite to that first described above. Resultantly, screw axle 576 turns in the opposite direction to that described above to cause riser 502 to move downwardly a short distance and thereby retract the product back into the cartridge 513.

End tabs 521, 523 are formed on the respective oppositely facing ends 525, 527 of cartridge 513 to lock the cartridge into body 512. Respective flanges 571, 531 are formed on the terminal ends of end tabs 521, 523 to facilitate such locking action. Slots 575 may be provided on opposite sides of tabs 521, 523 to enhance the snap-locking action of the tabs by permitting resilient movement thereof.

Cartridge 513 is retained within body 512 by sliding the cartridge into the body and pushing the cartridge until flange 571 or 531 on end tab 521, 523 locks below notch 551 formed on access opening 577 in body 512 (see FIGS. 38 and 39). Cartridge 513 has end tabs 521, 523 at each end for symmetry of assembly, but only one tab 521 or 523 positioned adjacent access opening 577 locks in below notch 551; the other end tab merely remains pushed in against the opposite inside wall of body 512. The top end 515 of cartridge 513 projects above open end 514 of body 512 when the cartridge is positioned within the body in order to facilitate cartridge top use and to enable a user to grip the cartridge with his fingers/hand to facilitate removal of the cartridge from the housing.

In order to release cartridge 513 from its lock position to enable removal from body 512, toggle trigger 522 is pivoted so that lower end 590 moves toward base 541 causing protrusions 567 formed on the inner lower surface of trigger 522 to engage against flange 571 or 531 and move same out of engagement below notch 551 (see FIGS. 38–41). Simultaneously, the user pulls on top end 515 of the cartridge to slide the same out of body 512.

Referring to FIGS. 43–54, alternate body 512' with cartridge 513' is provided with cooperative side locking tabs 521', 523' for engagement within side tab openings 553 to lock the cartridge 513' within body 512'. Tabs 521', 523' are symmetrically located on both sides of cartridge 513' for symmetry of assembling 180 degrees in either direction, but only the two tabs nearest the toggle trigger ledge 588 which passes through access opening 577 in body 512' lock in to openings 553; the other side tabs 521', 523' merely are engaged against the inside wall of body 512'. In all other respects, the cartridge 513' and body 512' are constructed the same as cartridge 513 and body 512.

Figure 52:
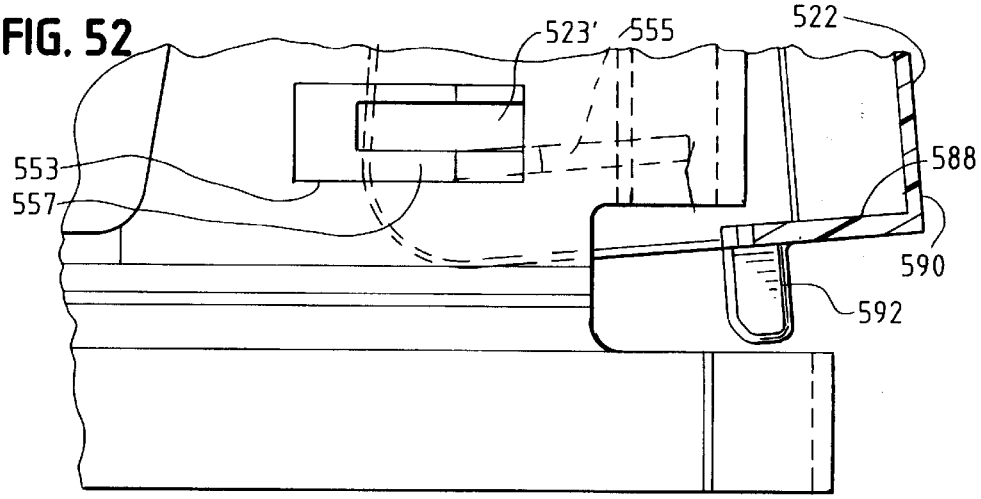
FIG. 52 is a fragmentary, partially sectional view taken through the lower corner of the dispenser assembled as in FIG. 50, showing the toggle trigger moved to a first activated position.
Figure 53:
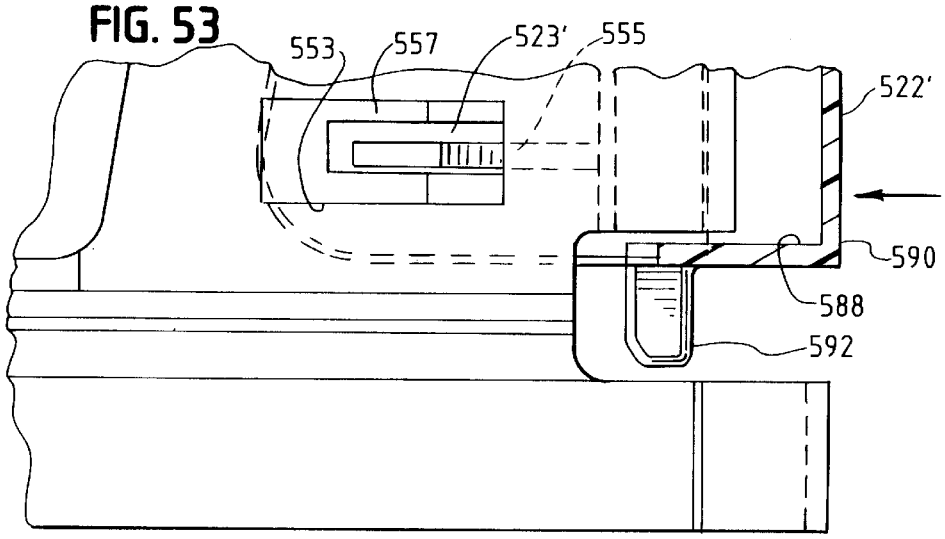
FIG. 53 is a view similar to that of FIG. 52, but showing the toggle trigger disposed in its neutral rest position.
Figure 54:
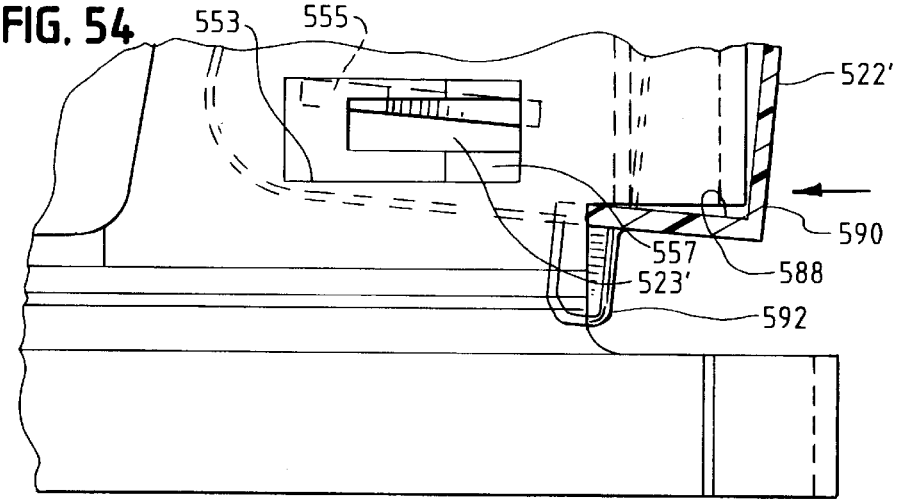
FIG. 54 is a view similar to that of FIG. 52, but showing the toggle trigger moved to a second activated position.
Figure 55:
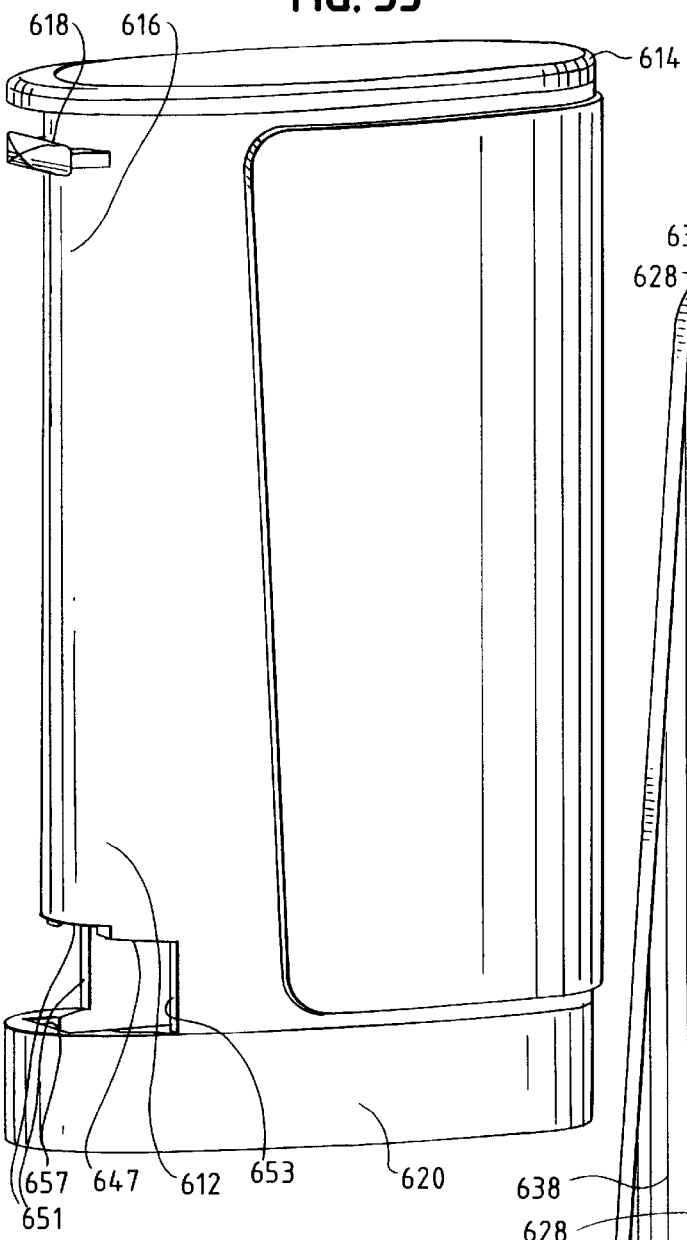
FIG. 55 is a perspective view of the body portion of the hinge trigger activated dispenser within which a cartridge having end tabs is received.
Figure 56:
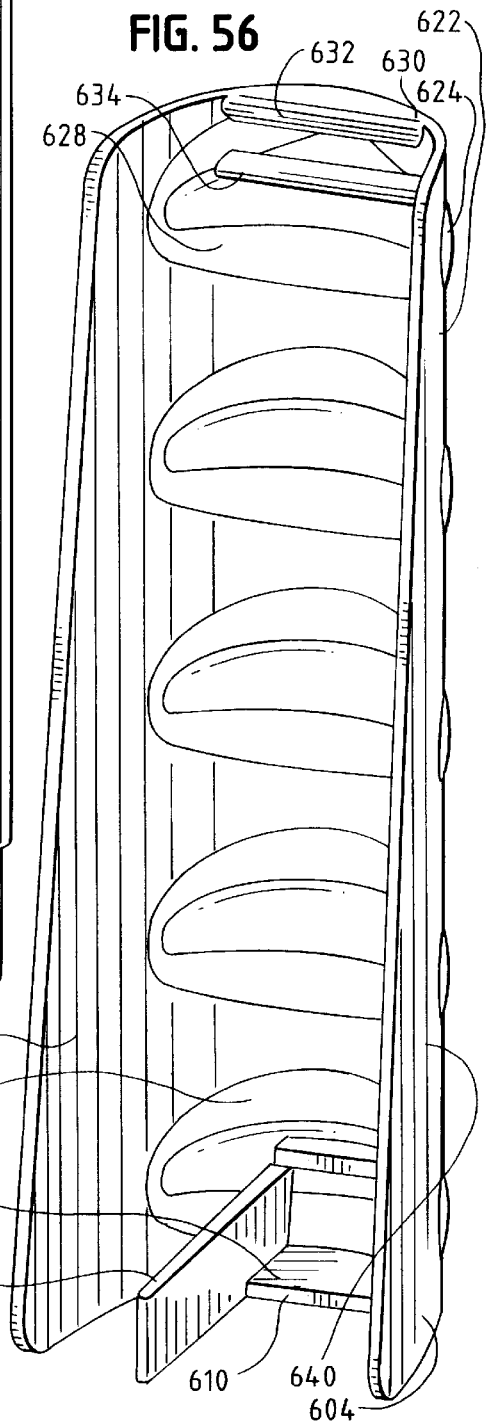
FIG. 56 is a rear perspective view of the hinge trigger for use with the body shown in FIG. 55.

Side tab openings 553 provided in body 512' have rib clearance spaces 557 to permit movement of wing ribs 555 formed on the inside surface 528' of toggle trigger 522' (see FIGS. 52–54). Tabs 521', 523' engaged withing openings 553 can be released when toggle trigger 522' is in its neutral position (see FIG. 53). In such position, tabs 521', 523' can be released by squeezing wings 538', 540' toward each other causing ribs 555 to disengage tabs 521', 523' from openings 553, thus permitting the cartridge 513' to be slidably removed from body 512'.

As an alternative to the product dispenser 500 having body 512 and cartridge 513 for use with a toggle trigger, FIGS. 20 and 55–70 illustrate a product dispenser 600 (shown assembled in FIG. 62) which is similar in construction to the product dispenser 200 shown in FIGS. 17–18 and 21–31 which utilizes a hinge trigger 222. Product dispenser 600 includes body portion 612 for use with product retaining cartridge 613 which is removably positionable within body 612, thereby enabling dispenser 600 to be re-usable with a fresh cartridge 613 when desired. Body portion 612 has open end 614 for receipt of cartridge 613 in the same manner as in the previously described embodiments.

Body 612 is provided on the external surface 616 thereof with a pivot flange 618 which extends from the surface 616 at a location proximate to open end 614. Hinge trigger 622 is provided for positioning against the external surface 616 of body 612 (see FIGS. 62 and 65). The interior surface 628 of hinge trigger 622 is formed with a pivot flange engaging clip 630 having a pair of parallel spaced snap members 632, 634 which snap-fit upon pivot flange 618 to secure hinge trigger 622 to body 612.

Base 641 is provided for attachment to body 612 to close end 620 thereof which is disposed opposite end 614. Base 641 is of generally cup-shaped configuration with a bottom wall 642 and a circumferentially disposed upstanding end wall 625. End wall 625 is formed on the inner-facing surface 646 thereof with a projecting rib 648 to be matingly engaged within circumferential groove 650 formed on body 612 for snap-fit attachment of the base 641 upon the body 612.

An upstanding, centrally-located boss 652 is formed on bottom wall 642 of base 641 for positioning within alignment passageway 673 formed within gear 674 and connected screw axle 676 in a manner to be described hereafter. Base 641 includes spring arm 649 upstanding from bottom wall 642 proximate to end 643.

Product retaining cartridge 613 is provided for removable positioning within body 612. Cartridge 613 includes cartridge body 615 having the same cross-sectional configuration as that of dispenser body 612 so that cartridge 613 is slidably positionable within body 612. Gear 674 and connected screw axle 676 is mounted within cartridge 613 by engagement of axle 676 within threaded passageway 629 formed in riser 602 positioned within cartridge 613. Alignment passageway 673 formed within gear 674 is positioned over boss 652 when cartridge 613 is positioned within body 612. Guard disc 617 is formed upon gear 674 proximate its connection with axle 676 and engages the lower edge 683 of cartridge 613 to prevent the gear from moving upwardly into cartridge 613 when riser 602 is being pulled downwardly during operation of the dispenser 600.

Hinge trigger 622 includes protruding finger 623 formed on the interior surface 628 thereof proximate the lower end 604. Ledge 606 is positioned between wings 638, 640 of the hinge trigger also proximate to the lower end 604, and includes a depending catch 608 for a purpose to be described. Access opening 647 in body 612 permits access of ledge 606 with finger 623 into body 612.

Ledge 606 has a lead edge 610 which abuts spring arm 649 when hinge trigger 622 is assembled upon body 612. When gear 674 with screw axle 676 is positioned upon boss 652, finger 623 on hinge trigger 622 engages the single acting angled teeth 686 of gear 674. Ledge 606 pushes against spring arm 649 and acts as a positive stop against the sides 651, 653 of access opening 647. Lip 657 on access opening 647 acts as a lock for catch 608 on the hinge trigger when the same is assembled on body 612.

The product engaging platform or riser 602 positioned within body 612 includes a top, product engaging, wall 675 from which a circumferential wall 679 depends. The terminal ends 677 of wall 679 engage the inner facing walls 611 of cartridge 613, but are slidable therealong as the riser is moved up or down within the cartridge. A product in solid form (not shown) to be dispensed from the dispenser 600 is placed within cartridge 613 and rests between top surface 603 of riser 602 and top open end 619 of cartridge 613.

Riser 602 is formed on the underside 659 of wall 675 with a depending sleeve 639 having a threaded interior passageway 629 which opens at hole 600 on the top wall 675. Threads 631 in passageway 629 are formed to mate with screw threads 632 on screw axle 676 when gear 674 and axle 676 are positioned upon boss 652 with axle 676 passing through passageway 629. Thus, when gear 674 with screw axle 676 is turned, the screw threads 632 moving against passageway threads 631 impart upward movement to the riser to move the product retained thereagainst within cartridge 613. End 667 of passageway 629 is formed with a seal surface 636 to seal against screw axle seal surface 689 to prevent leakage of product retained in cartridge 613 into the area below riser 602.

The single-acting angled teeth 686 of gear 674 are adapted to be turned in one direction only by gear engagement finger 623 formed on hinge trigger 622. Hinge trigger 622 is pivotal against pivot flange 618 between a first rest position (see FIGS. 59 and 62), and a second, activated position in which the lower end 604 is retracted toward base 641 (see FIG. 60).

When it is desired to advance or dispense product from dispenser 600, the user wraps his hand about body 612 with the digits of the user's hand resting against external surface 624 of hinge trigger 622. The user then depresses his little finger digit to cause the hinge trigger to pivot about pivot flange 618 which causes the lower end 604 to move toward end 620 of body 612, thereby pushing ledge 606 against spring arm 649 and finger 623 to engage gear teeth 686 and move the gear one notch. Resultantly, screw axle 676 turns to cause riser 602 to move upwardly a short distance and thereby move or advance the product retained within cartridge 613 toward open end 619 to be dispensed therefrom. When the user relaxes his little finger digit to release hinge trigger 622, spring arm 649 returns to its neutral position, moving ledge 606 and hinge trigger 622 also to its first rest position.

Figure 57:
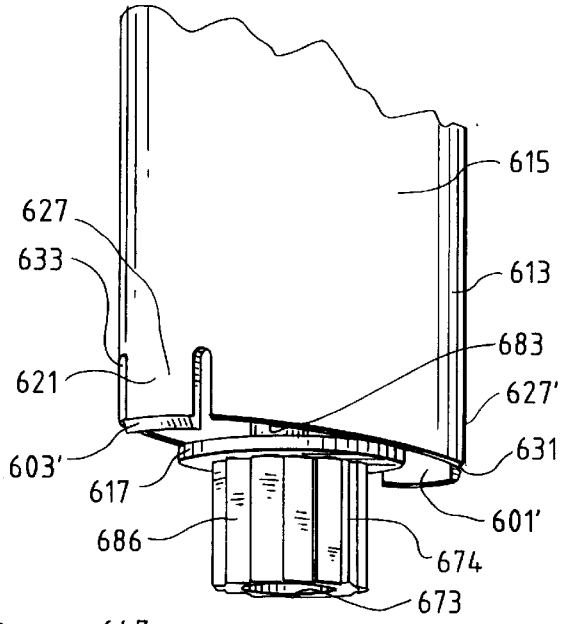
FIG. 57 is a fragmentary perspective view of a cartridge having end tabs, with screw for use with the hinge trigger activated dispenser body shown in FIG. 55.
Figure 58:
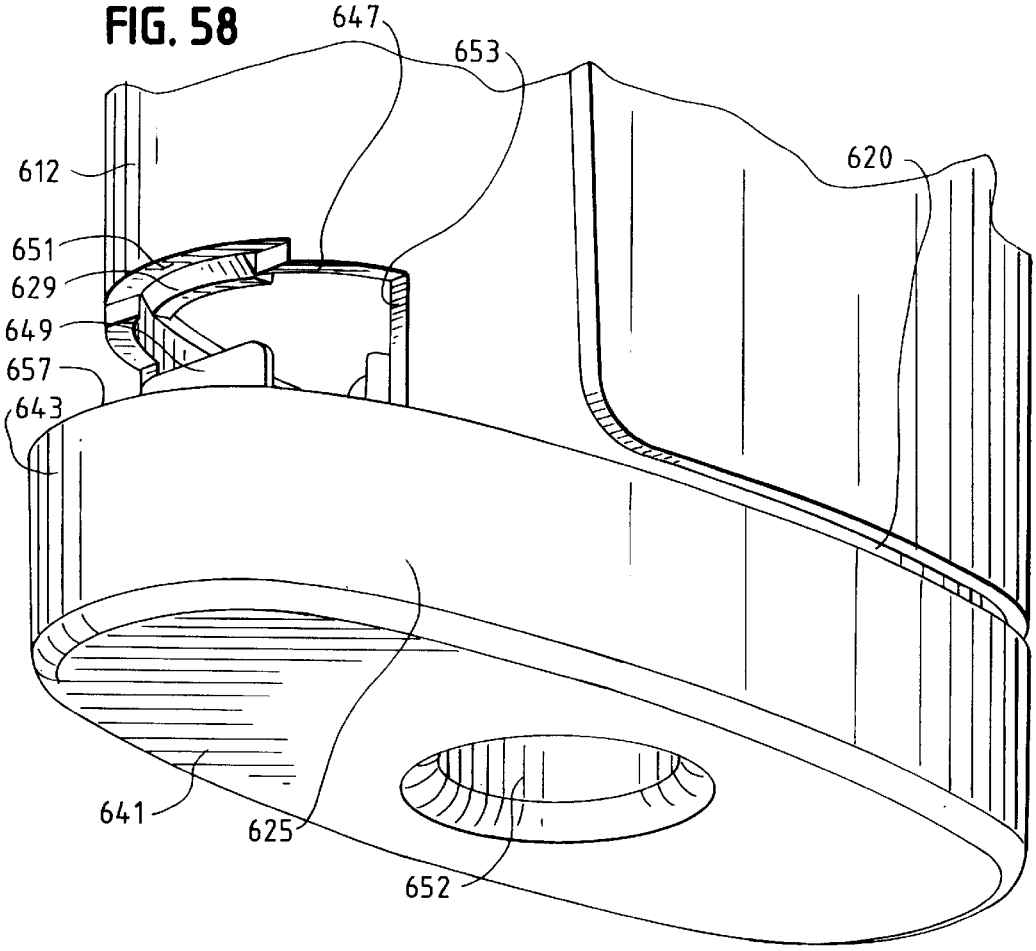
FIG. 58 is a bottom perspective view of a hinged dispenser body for receipt of the cartridge having end tabs shown in FIG. 57.
Figure 59:
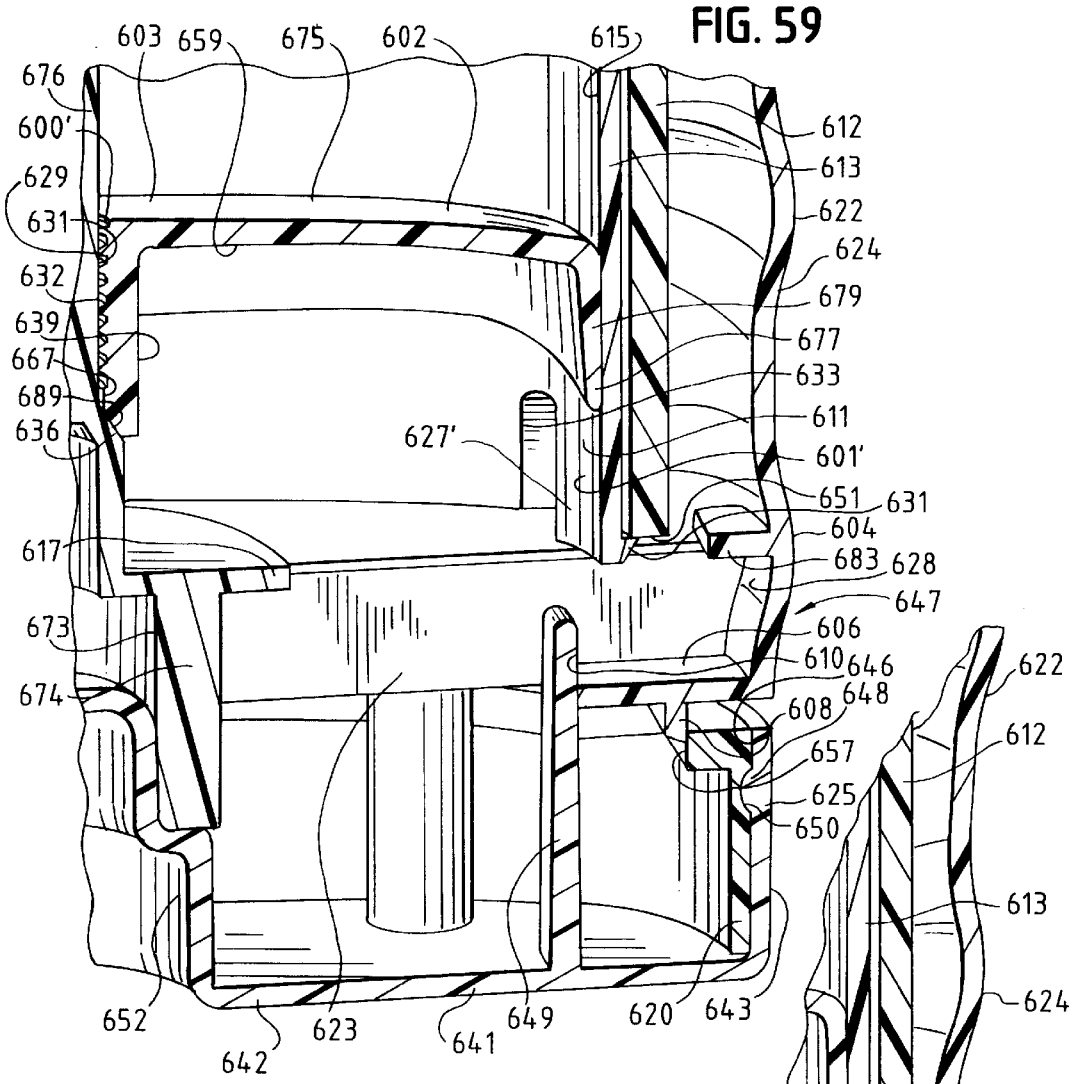
FIG. 59 is an enlarged fragmentary sectional view taken through a lower corner of the dispenser body shown in FIG. 55 assembled with the cartridge shown in FIG. 57 and the trigger shown in FIG. 56.
Figure 60:
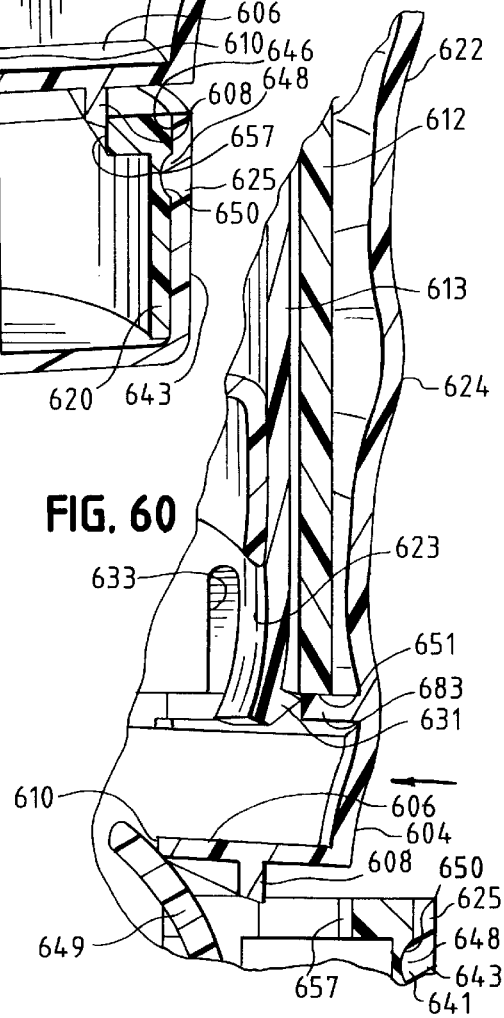
FIG. 60 is an enlarged fragmentary section view of a portion of FIG. 59, the same being shown with the hinge trigger moved to activated position.

End tabs 621, 601 are formed on the respective oppositely facing ends 627, 627' of cartridge 613 to lock the cartridge into body 612 (see FIGS. 57 and 59–60). Respective flanges 603, 631 are formed on the terminal ends of tabs 621, 623 to facilitate such locking action. Slots 633 may be provided on opposite sides of tabs 621, 623 to enhance the snap-locking action of the tabs by permitting resilient movement thereof.

Cartridge 613 is retained within body 612 by sliding the cartridge into the body and pushing the cartridge until flange 629 or 631 on end tab 621, 623 locks below notch 651 formed on access opening 647 in body 612 (see FIG. 59). Cartridge 613 has end tabs 621, 623 at each end for symmetry of assembly, but only one tab 621 or 623 positioned adjacent access opening 647 locks in below notch 651; the other end tab merely remains pushed in against the opposite inside wall of body 612. The top end 619 of cartridge 613 projects above open end 614 of body 612 when the cartridge is positioned within the body in order to facilitate cartridge top use and to enable a user to grip the cartridge with his fingers/hand to facilitate removal of the cartridge from the housing.

In order to release cartridge 613 from its lock position to enable removal from body 612, toggle trigger 622 is pivoted so that lower end 604 moves toward base 641 causing end release protrusion 683 formed on the inner lower surface of trigger 622 to engage against flange 629 or 631 and move same out of engagement below notch 651 (see FIG. 60). Simultaneously, the user pulls on top end 619 of the cartridge to slide the same out of body 612.

Referring to FIGS. 63–70, alternate body 612' with cartridge 613' is provided with cooperative side locking tabs 621', 623' for engagement within side tab openings 653 to lock the cartridge 613' within body 612'. Tabs 621', 623' are symmetrically located on both sides of cartridge 613' for symmetry of assembling 180 degrees in either direction, but only the two tabs nearest the toggle trigger ledge 688 which passes through access opening 671 in body 612' lock in to openings 653; the other side tabs 621', 623' merely are engaged against the inside wall of body 612'. In all other respects, the cartridge 613' and body 612' are constructed the same as cartridge 613 and body 612.

Figure 66:
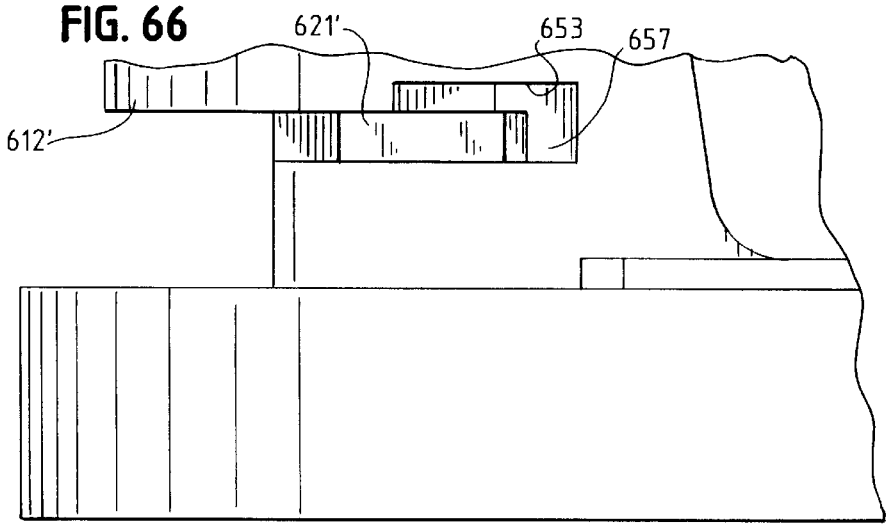
FIG. 66 is a fragmentary side view of the lower portion of the dispenser shown in FIG. 65 with the cartridge having side tabs shown in FIG. 63 assembled therein.
Figure 67:
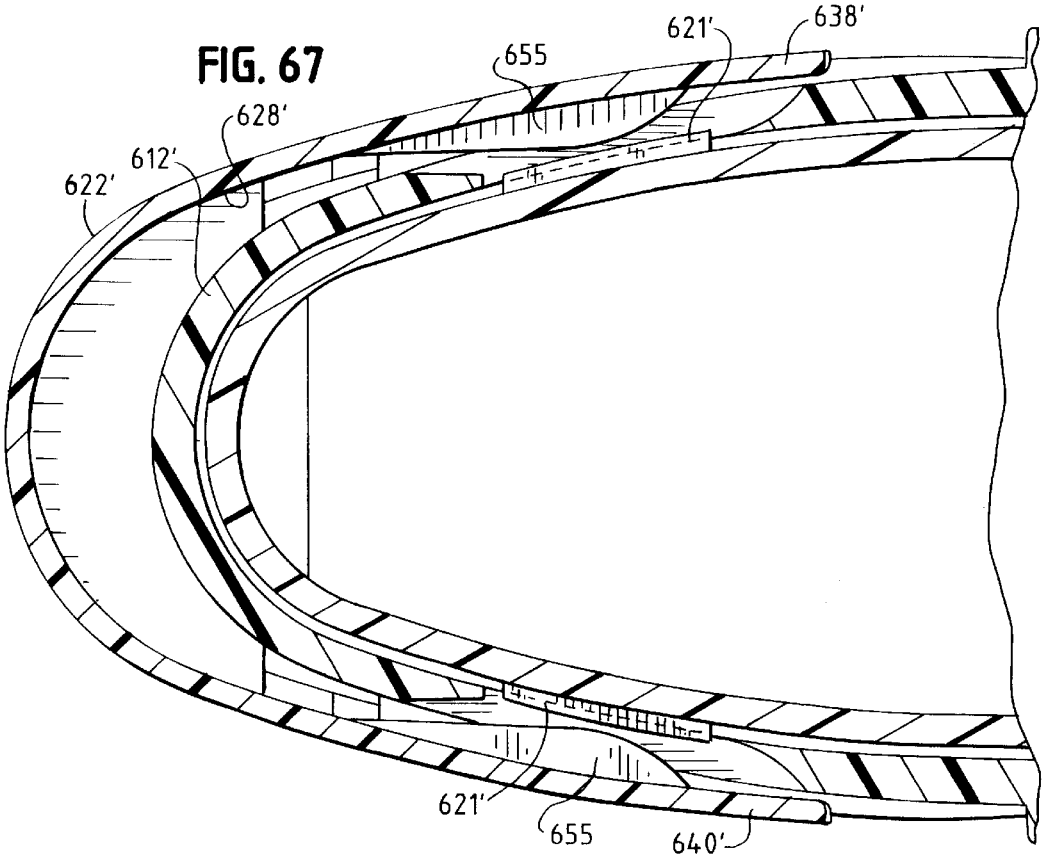
FIG. 67 is a sectional view of the lower portion of the dispenser assembled as in FIG. 66.
Figure 68:
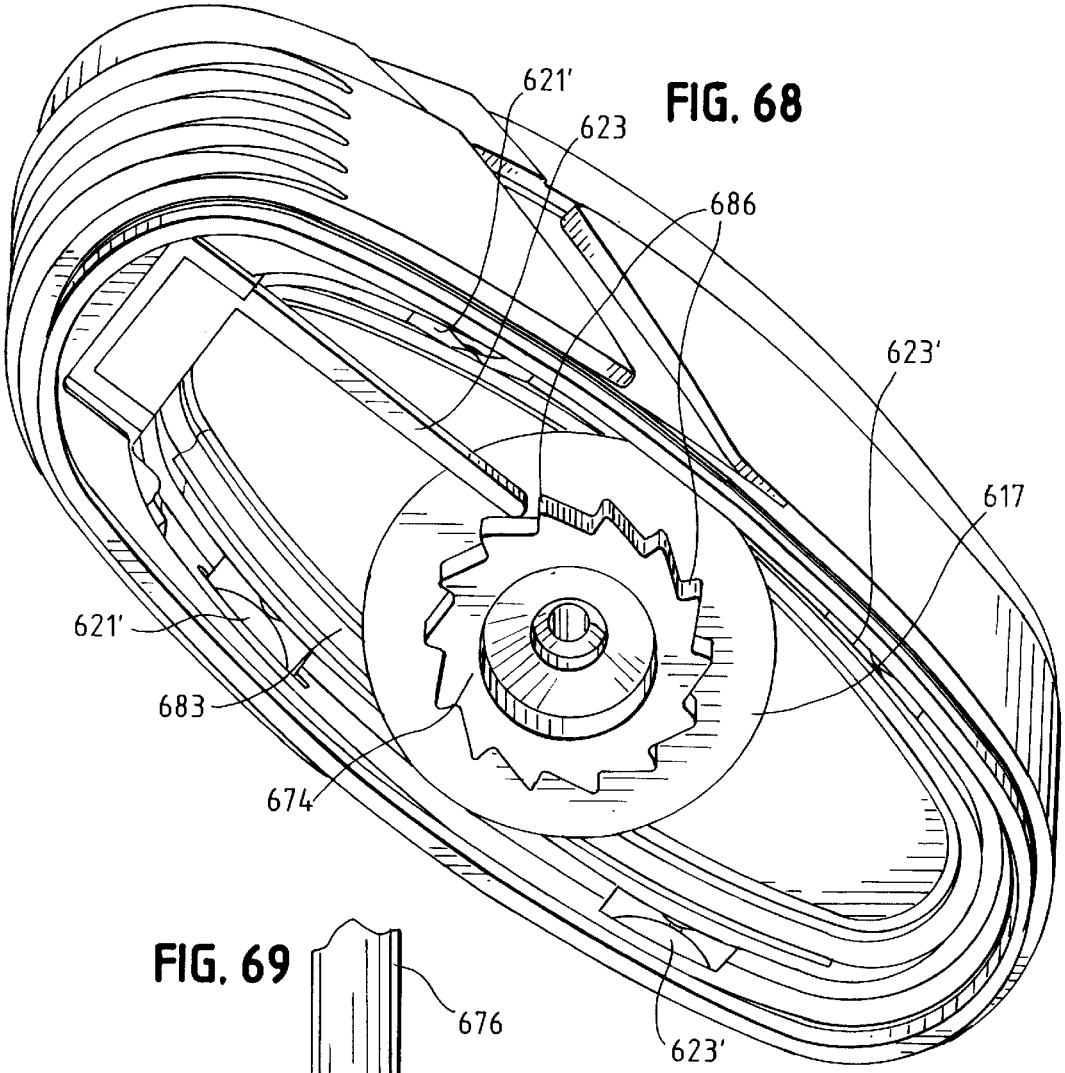
FIG. 68 is a bottom view, in section, of the hinge trigger dispenser of the invention, with cartridge installed therein.
Figure 69:
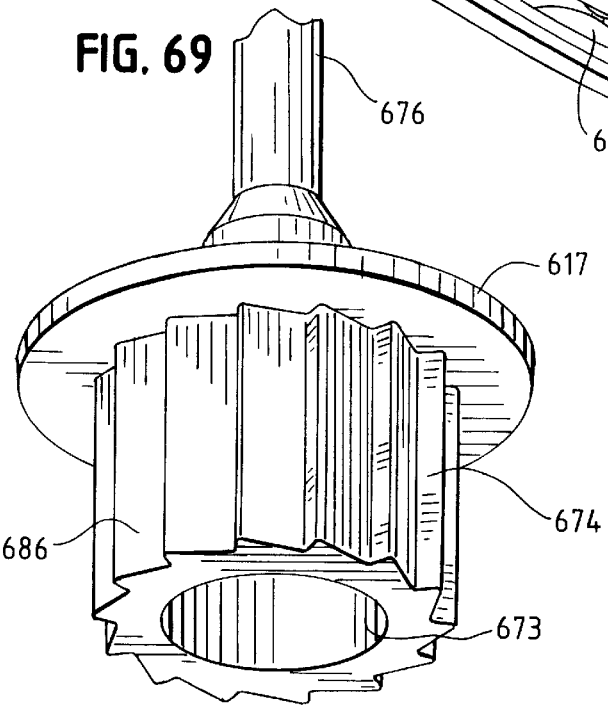
FIG. 69 is a fragmentary perspective view of the gear and screw axle portion of the cartridge shown in FIG. 68.
Figure 70:
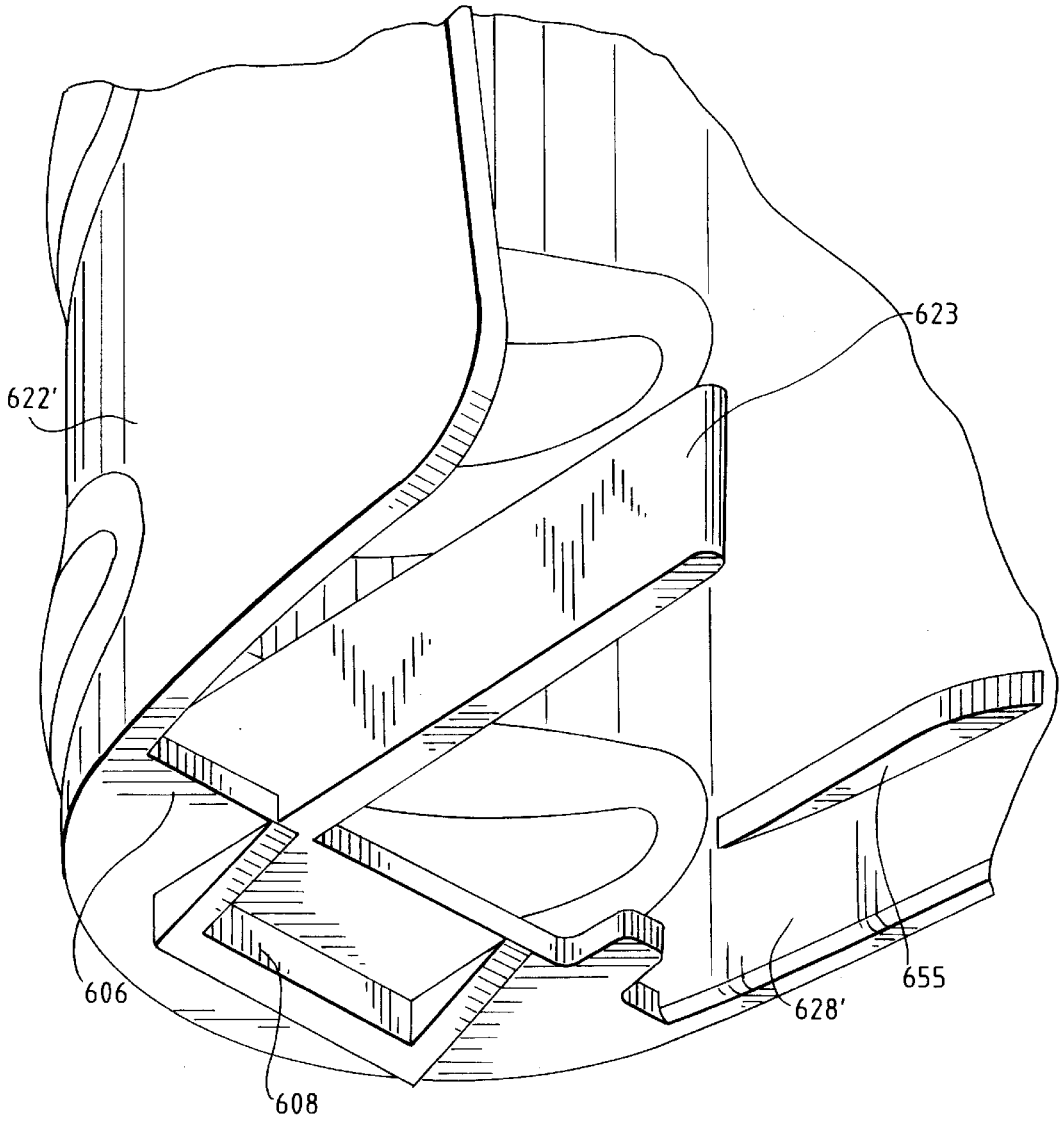
FIG. 70 is a fragmentary perspective view of the lower left-hand corner section of the hinge trigger of the invention for use with a cartridge having side release tabs shown in FIG. 63.

Side tab openings 653 provided in body 612' have rib clearance spaces 657 to permit movement of wing ribs 655 formed on the inside surface 628' of hinge trigger 622' (see FIG. 66). Tabs 621', 623' engaged within openings 653 can be released when toggle trigger 622' is in its neutral position. In such position, tabs 621', 623' can be released by squeezing wings 638', 640' toward each other causing ribs 655 to disengage tabs 621', 634' from openings 653, thus permitting the cartridge 613' to be slidably removed from body 612'.

Figure 61:
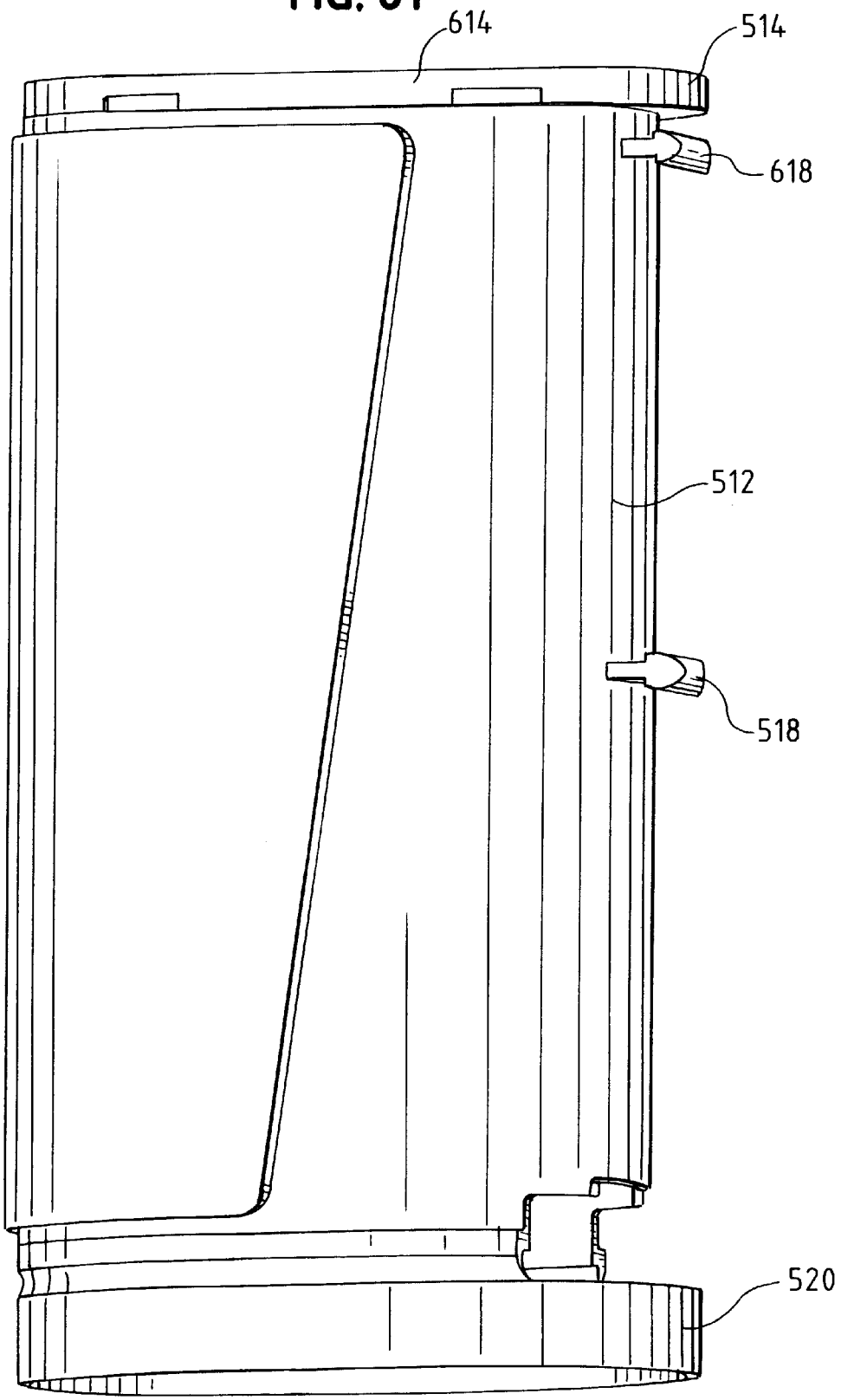
FIG. 61 is a perspective view of a dispenser body adapted for receipt of the cartridge shown in FIG. 57, the body being illustrated with alternate pivot points centrally located or top located on the body surface.
Figure 62:
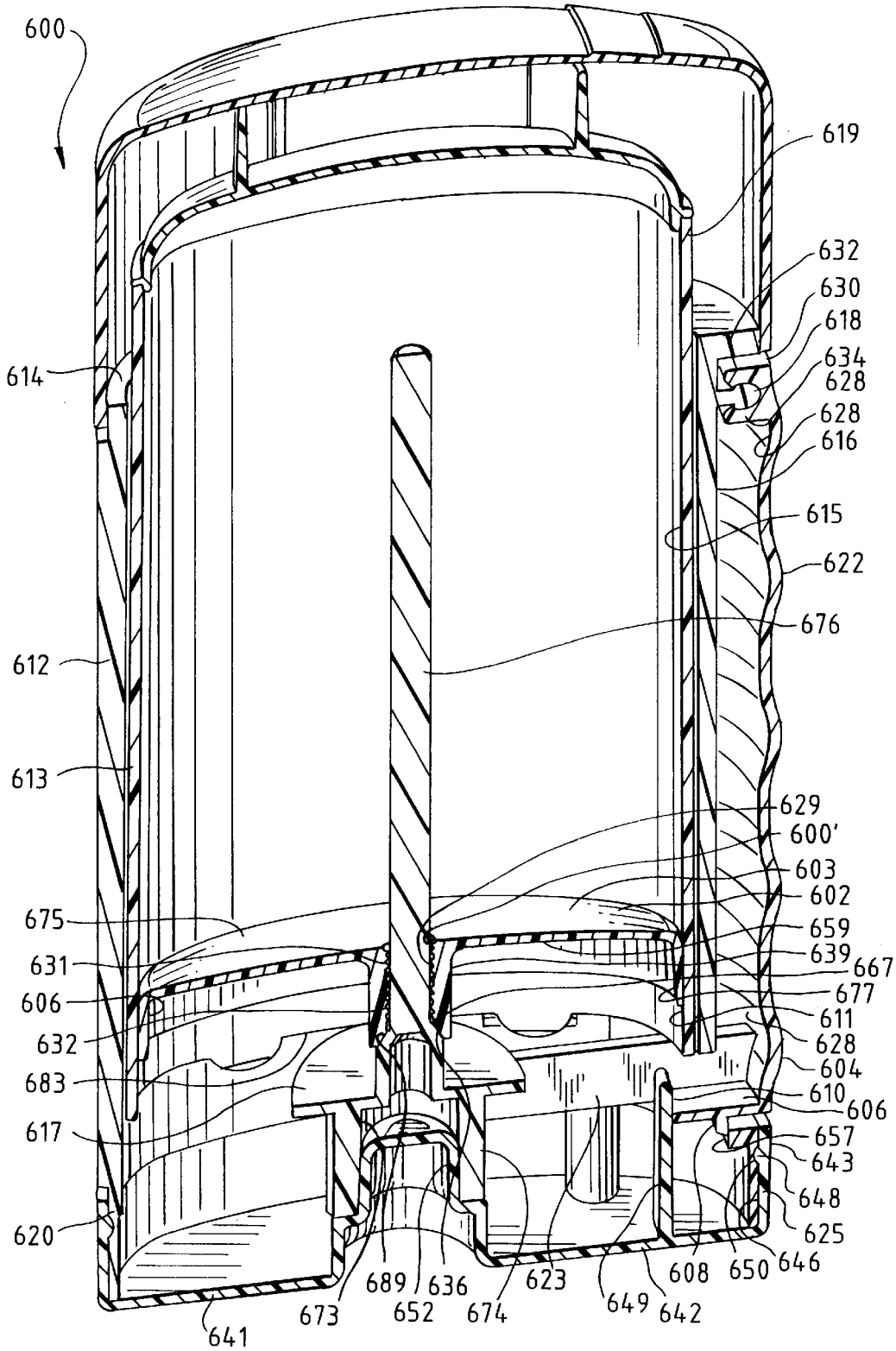
FIG. 62 is a longitudinal section view taken through the hinge trigger activated dispenser of the invention with cartridge having side tabs installed therein.
Figure 63:
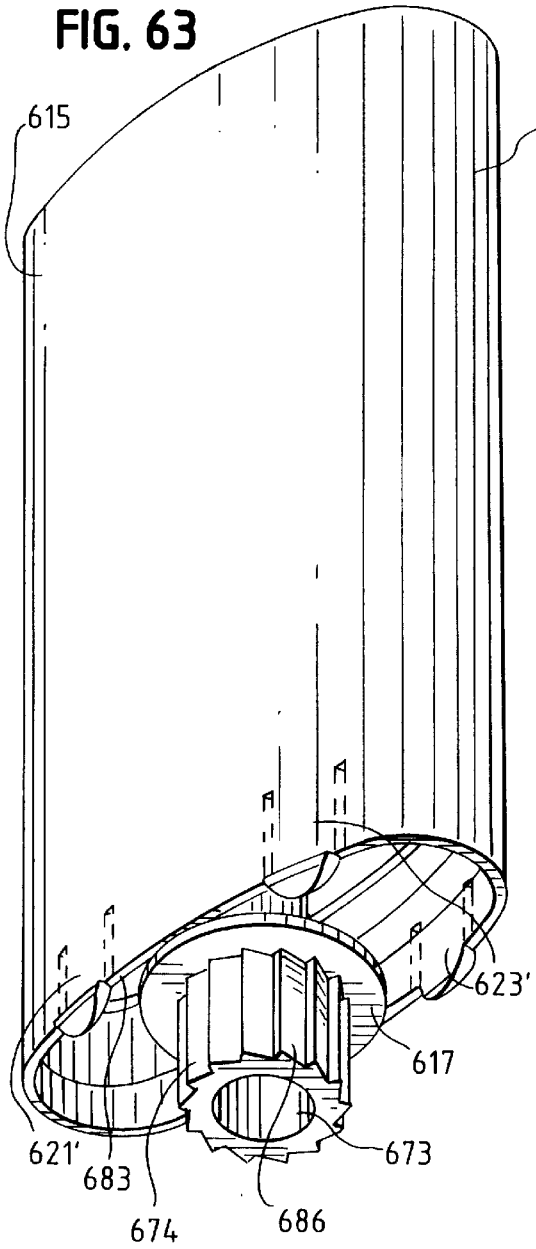
FIG. 63 is a bottom perspective view of a cartridge having side tabs for use in a hinge trigger dispenser of the invention.
Figure 64:
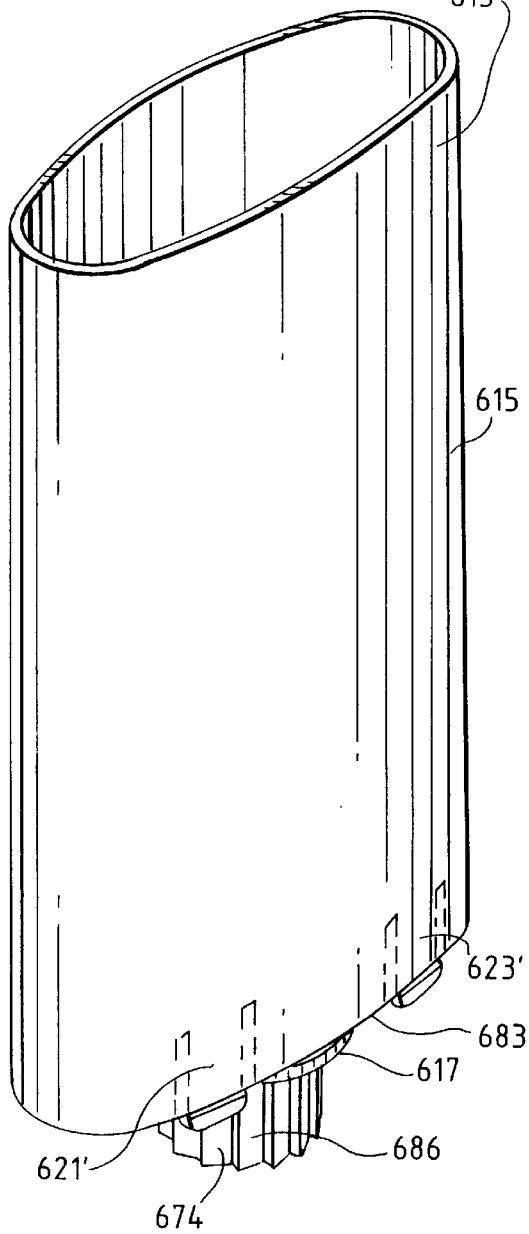
FIG. 64 is a top perspective view of the cartridge shown in FIG. 63.
Figure 65:
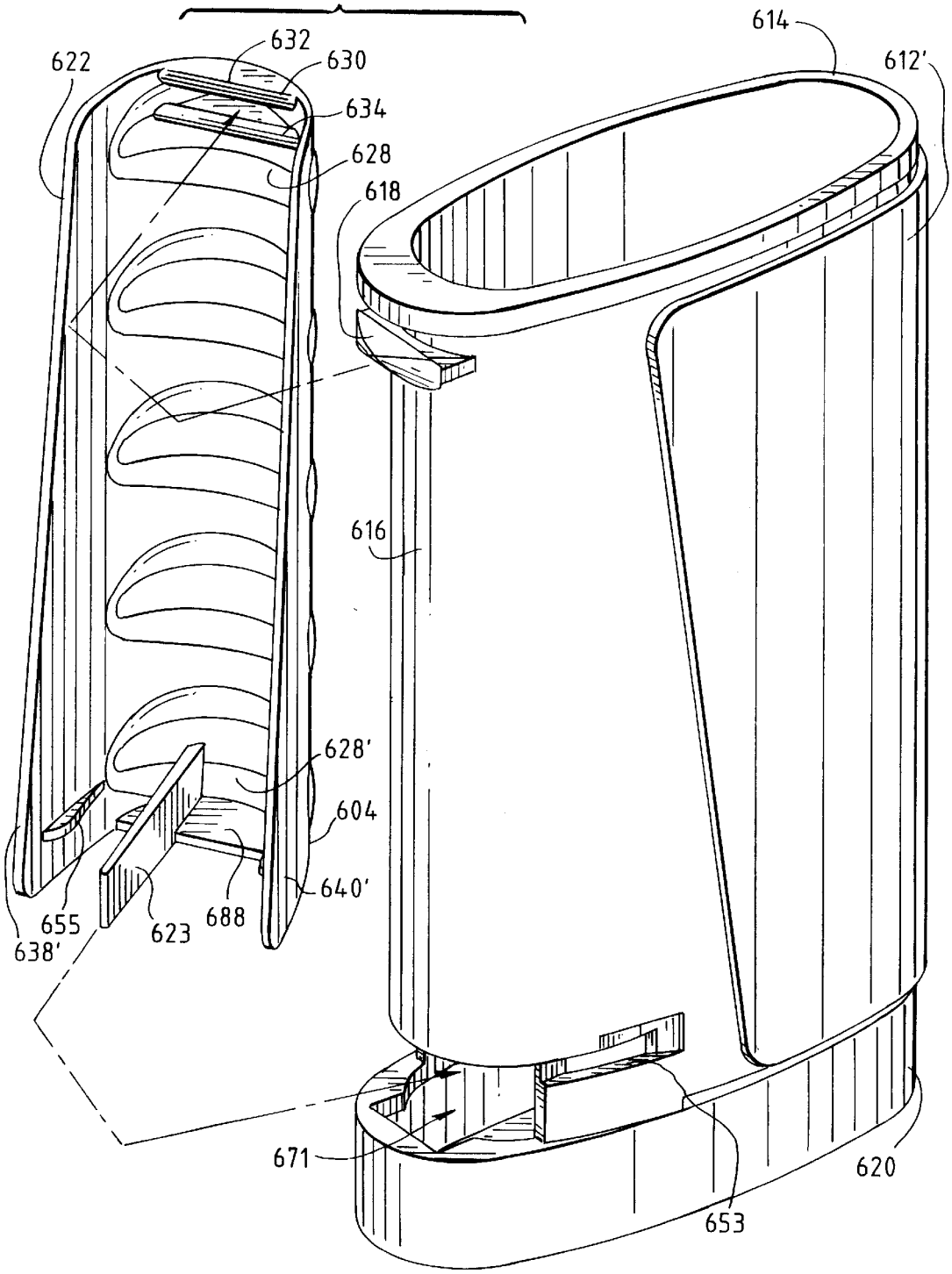
FIG. 65 is an exploded perspective view of the hinge trigger dispenser of the invention for use with the cartridge having side tabs shown in FIG. 63.

Minor variations in the structure and other variations in the arrangement and size of the various parts may occur to those skilled in the art without departing from the spirit or circumventing the scope of the invention as set forth in the appended claims. To be noted, as illustrated in FIG. 61, dispenser body 512 may conveniently be formed either with a pivot flange 518 located spaced approximately mid-length the distance between open end 514 (or 614) and opposite end 520 thereof (as in FIG. 47) so that the dispenser accommodates a toggle trigger, or with pivot flange 618 located proximate to open end 514 (or 614) (as in FIG. 55) so that the dispenser accommodates a hinge trigger. Thus, the dispenser of the invention is readily adaptable to function with either type of trigger.

What is claimed is:

1. A dispenser for dispensing a product retained therein, said dispenser comprising, a body within which said product is retained, the body including an external surface and a top dispensing end and a bottom closed end, a pivot flange positioned on said external surface, a trigger mounted on said body and being pivotal thereon about the pivot flange when a user's hand is wrapped about the body with the user's hand positioned upon the trigger, a screw gear with connected axle positioned within the body, a gear advancing member attached to said trigger and adapted to engage said screw gear upon movement of said trigger, a platform having a top surface mounted upon said axle with said product disposed between said top surface and the top dispensing end of the body, said platform being movable within said body when said screw gear is turned, whereby upon movement of the trigger by the user's hand the gear advancing member engages the gear to cause the gear and axle to move and thereby move the platform toward the top dispensing end to dispense the product from the dispenser.

2. A dispenser as claimed in claim 1 in which the side of the trigger which faces said body is provided with a clip to be engaged upon said pivot flange.

3. A dispenser as claimed in claim 2 which said clip includes a pair of parallel spaced snap members which snap-fit upon said pivot flange.

4. A dispenser as claimed in claim 1 in which the pivot flange extends from said external surface at a location spaced approximately mid-length the distance between said top dispensing end and said bottom closed end.

5. A dispenser as claimed in claim 4 in which said trigger is a toggle trigger pivotal about said pivot flange between a first rest position and a second activated position in which a top end of the toggle trigger is moved toward the top dispensing end of the body.

6. A dispenser as claimed in claim 5 in which the toggle trigger is pivotal to a third activated position in which a bottom end of the toggle trigger is moved toward the bottom closed end of the body.

7. A dispenser as claimed in claim 5 in which the toggle trigger includes a pair of generally U-shaped wings positioned on opposite sides of said body.

8. A dispenser as claimed in claim 1 including a product retaining cartridge removably positionable within the body.

9. A dispenser as claimed in claim 8 including a base adapted to be attached to the bottom end of the body, said base being of generally cup-shaped configuration with a bottom wall and a circumferentially disposed upstanding end wall, an upstanding centrally-located boss formed on said bottom wall, said gear having an alignment passageway formed therein adapted to be engaged upon said upstanding boss when said cartridge is positioned within the body.

10. A dispenser as claimed in claim 9 in which the cartridge includes at least one tab formed thereon and said body includes at least one matingly engageable tab-receiving opening to releasably lock said cartridge within said body.

11. A dispenser as claimed in claim 10 in which the trigger includes a pair of generally U-shaped wings positioned on opposite sides of said body, said wings including at least one rib adapted for engagement into said opening, said tab being releasable from the opening when the wings are moved toward each other to move the tab out of the opening.

12. A dispenser as claimed in claim 10 in which the trigger has at least one protrusion formed on a lower end thereof and facing the external surface of the body, said protrusion adapted for engagement into said opening, said tab being releasable from the opening when the lower end of the trigger with the protrusion is moved into engagement with the tab.

13. A dispenser as claimed in claim 1 including a base adapted to be attached to the bottom end of the body, said base being of generally cup-shaped configuration with a bottom wall and a circumferentially disposed upstanding end wall.

14. A dispenser as claimed in claim 8 including an upstanding centrally-located tower formed on said bottom wall, said tower having a mounting hole formed therein for receipt of said screw gear and connected axle.

15. A dispenser as claimed in claim 14 including a spring positioned on said base resting on the bottom wall thereof, said spring having an elongate main wall with oppositely disposed generally circular terminal portions, each of said terminal portions being formed with a respective mounting hole to facilitate positioning of the spring on the base, a pair of upstanding mounting posts formed on said bottom wall positioned on opposite sides of said tower, said mounting holes being engaged upon respective ones of said posts.

16. A dispenser as claimed in claim 15 in which said gear advancing member includes a pair of gear engagement ribs formed on the elongate main wall of said spring, said gear having double-acting symmetric teeth and said gear engagement ribs being disposed for selective engagement with said double-acting symmetric teeth.

17. A dispenser as claimed in claim 16 in which the toggle trigger includes a pair of generally U-shaped wings positioned on opposite sides of said body, a ledge formed proximate a bottom end of the toggle trigger between said wings, a depending nub formed on said ledge, said nub being engageable with said spring and operable to flex the spring when the toggle trigger is pivoted about said pivot flange so that the bottom end of the toggle trigger is moved toward the bottom end of the body.

18. A dispenser as claimed in claim 17 in which one of said gear engagement ribs engages a tooth of said gear when the spring is flexed, thereby turning the gear in a first direction to cause the platform to resultantly move in a first direction within the body.

19. A dispenser as claimed in claim 18 in which the other of said gear engagement ribs engages a tooth of said gear when the spring is flexed by pivoting the toggle trigger about the pivot flange so that the bottom end of the toggle trigger is moved away from the bottom end of the body, thereby turning the gear in a second direction opposite to said first direction to cause the platform to resultantly move in a second direction within the body.

20. A dispenser as claimed in claim 1 in which the pivot flange extends from said external surface at a location proximate to said top dispensing end.

21. A dispenser as claimed in claim 15 in which said trigger is a hinge trigger pivotal about said pivot flange between a first rest position and a second activated position in which a bottom end of the hinge trigger is moved toward the bottom closed end of the body.

22. A dispenser as claimed in claim 21 in which the hinge trigger includes a pair of generally U-shaped wings positioned on opposite sides of said body.

23. A dispenser as claimed in claim 22 including a base adapted to be attached to the bottom end of the body, said base being of generally cup-shaped configuration with a bottom wall and a circumferentially disposed upstanding end wall.

24. A dispenser as claimed in claim 23 including an upstanding centrally-located tower formed on said bottom wall, said tower having a mounting hole formed therein for receipt of said screw gear and connected axle.

25. A dispenser as claimed in claim 24 including a spring arm upstanding from said bottom wall, a ledge formed proximate to a bottom end of the hinge trigger between said wings, said ledge having a lead edge which abuts said spring arm, said gear advancing member including a protruding finger formed on said hinge trigger proximate to said ledge and extending into said body.

26. A dispenser as claimed in claim 25 in which said gear has single-acting teeth adapted to be turned in one direction only, said protruding finger being disposed for selective engagement with said single-acting teeth when the hinge trigger is pivoted about said pivot flange so that the bottom end of the hinge trigger is moved toward the bottom end of the body thereby turning the gear to cause the platform to resultantly move within the body.

* * * * *

UNITED STATES PATENT AND TRADEMARK OFFICE

CERTIFICATE OF CORRECTION

PATENT NO. : 6,269,982 B1
DATED : August 7, 2001
INVENTOR(S) : Walter J. Kreiseder et al.

It is certified that error appears in the above-identified patent and that said Letters Patent is hereby corrected as shown below:

Column 16,
Change the dependency of claim 14 to depend from claim 13.

Column 18,
Change the dependency of claim 21 to depend from claim 20.

Signed and Sealed this

Fifth Day of March, 2002

*Attest:*

*Attesting Officer*

JAMES E. ROGAN
*Director of the United States Patent and Trademark Office*